US009356369B2

(12) United States Patent
Tamai

(10) Patent No.: US 9,356,369 B2
(45) Date of Patent: May 31, 2016

(54) INTERMEDIATE ELECTRICAL CONNECTOR AND ELECTRICAL CONNECTOR ASSEMBLED COMPONENT

(71) Applicant: Hirose Electric Co., Ltd., Tokyo (JP)

(72) Inventor: Nobuhiro Tamai, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/487,163

(22) Filed: Sep. 16, 2014

(65) Prior Publication Data

US 2015/0079819 A1 Mar. 19, 2015

(30) Foreign Application Priority Data

Sep. 17, 2013 (JP) ..... 2013-192123

(51) Int. Cl.

| | |
|---|---|
| ***H01R 24/00*** | (2011.01) |
| ***H01R 12/70*** | (2011.01) |
| ***H01R 13/6582*** | (2011.01) |
| ***H01R 13/6586*** | (2011.01) |
| *H01R 13/518* | (2006.01) |

(52) U.S. Cl.

CPC ..... *H01R 12/7082* (2013.01); *H01R 13/6582* (2013.01); *H01R 13/6586* (2013.01); *H01R 12/707* (2013.01); *H01R 13/518* (2013.01)

(58) Field of Classification Search

CPC ..... H01R 23/7068; H01R 27/00
USPC ..... 439/59, 218, 61, 502, 631
See application file for complete search history.

(56) References Cited

U.S. PATENT DOCUMENTS

| | | | | |
|---|---|---|---|---|
| 6,843,687 | B2 * | 1/2005 | McGowan et al. | 439/607.06 |
| 2012/0214343 | A1 | 8/2012 | Buck et al. | |

* cited by examiner

*Primary Examiner* — Phuongchi T Nguyen

(74) *Attorney, Agent, or Firm* — Kubotera & Associates, LLC

(57) ABSTRACT

An intermediate electrical connector to be connected to a mating connecting member includes an intermediate connecting member; and a blade disposed in the intermediate connecting member. The blade includes a first ground plate, a second ground plate, a base member, a signal terminal, and a ground terminal. The signal terminal includes a first contact portion and a first connecting portion connected to the first contact portion. The ground terminal includes a second contact portion and a second connecting portion connected to the second contact portion. The first ground plate is situated on one side of the blade over the first connecting portion and the second connecting portion. The second ground plate is situated on an opposite side of the blade over the first connecting portion, the second connecting portion, the first contact portion, and the second contact portion.

8 Claims, 16 Drawing Sheets

INTERMEDIATE ELECTRICAL CONNECTOR AND ELECTRICAL CONNECTOR ASSEMBLED COMPONENT

BACKGROUND OF THE INVENTION AND RELATED ART STATEMENT

The present invention relates to an intermediate electrical connector for connecting to a mating connecting member, which may include a mating connector or a circuit board. The present invention also relates to an electrical connector assembled component equipped with the intermediate electrical connector and the mating connector thereof.

As a conventional connector and a conventional electrical connector assembled component of this type, for example, Patent Reference has disclosed a conventional intermediate electrical connector.

Patent Reference: United States Patent Application Publication No. 2012/0214343

According to Patent Reference, the conventional electrical connector assembled component is mounted on a circuit board that forms a horizontal surface, and is fitted and connected to a mating connector from a side of the conventional intermediate electrical connector. Here, the mating connector includes an electrical connector for a circuit board to be mounted on another circuit board.

According to Patent Reference, the conventional intermediate electrical connector includes a plurality of blades and a housing. Each of the blades has a flat shape, and is respectively electrically connected to the mating connector and the circuit board. The housing arranges and holds the blades in a plate thickness direction thereof and in an arrangement direction thereof. Each of the blades includes a plurality of signal terminals and ground plates. The signal terminals are arranged by a flat base member so as to be arranged on a surface horizontal to a plate surface of the base member. The ground plates extend in a horizontal direction relative to a plate surface of the base member, corresponding to the range where the signal terminals are arranged.

In the conventional intermediate electrical connector, each signal terminal has a shape being bent between a side end and a lower end of the blade, and includes a signal contact portion and a signal connecting portion. The signal contact portion is provided on a side end of the blade for contacting with the mating connector. The signal connecting portion is provided at a lower end of the blade for connecting to the circuit board by soldering. Each signal terminal extends being bent between the signal contact portion and the signal connecting portion within a surface horizontal to the plate surface of the base member. The signal contact portion and the signal connecting portions are connected by a joining section. The signal contact portions and the signal connecting portions are disposed respectively protruding from side ends and lower end of the base member.

In the conventional intermediate electrical connector, the ground plates are provided to cover the range where the joining sections of the signal terminals are present. Moreover, the signal contact portions and the signal connecting portions of the signal terminals are not covered with the ground plates. Each ground plate includes a flexible grounding contact portion, which extends sideward from a side end of the ground plate being adjacent to the signal contact portion.

In the conventional intermediate electrical connector, the mating connector includes a plurality of mating signal terminals, a plurality of mating ground plates, and a housing. The mating signal terminals extend straight sideward, and are arranged corresponding to the signal terminals of the blade.

The mating ground plates are disposed corresponding to the arrangement range of the mating signal terminals. The housing holds the mating signal terminals and the mating ground plates.

In the conventional intermediate electrical connector, the mating signal terminal includes a mating signal contact portion at one end thereof and a mating signal connecting portion at the other end thereof. The mating signal contact portion is to be connected to the signal contact portion of the intermediate electrical connector. The mating signal connecting portion is to be connected to the signal circuit unit of the other circuit board. The mating signal contact portion and the mating signal connecting portions are joined with a mating joining section.

In the conventional intermediate electrical connector, the mating ground plates are provided so as to cover the range of the mating signal contact portions and the mating joining sections, which are provided on the mating signal terminals. Moreover, each mating ground plate includes a mating grounding contact portion being adjacent to the mating signal terminal. The mating grounding contact portions contact with the grounding contact portions of the ground terminals of the intermediate electrical connector. The mating grounding contact portions are formed to have a rib-like shape that protrudes from plate surfaces of the mating ground plates.

According to Patent Reference, when the mating connector is fitted and connected to the conventional intermediate electrical connector from a side thereof, the signal contact portions of the signal terminals and the grounding contact portions of the ground terminals, which are provided on the respective blades of the intermediate electrical connector, and the mating signal contact portions of the mating signal terminals and the mating grounding contact portions of the mating ground terminals of the mating connector contact to each other with contact pressure so as to be electrically connected to each other.

According to Patent Reference, the ground plates of the conventional intermediate electrical connector cover the range where the joining sections of the plurality of signal terminals are present, but do not cover the range where the signal contact portions of the signal terminals are present. Therefore, in a state that the conventional intermediate electrical connector is connected the mating connector, the contact parts, where the signal contact portions of the signal terminals and the mating signal terminals contact, are not shielded by the ground plates. Therefore, there is concern that signal transmission at the contact parts could be affected by noises from outside.

In addition, the signal terminals and the mating signal terminals are preferably configured so as to match the impedance to each other at the contact parts.

According to Patent Reference, as described above, the contact parts are not covered with the ground plates. Even if it is attempted to adjust the impedance to preferable values between the both signal terminals by forming a shielding section to cover the connecting parts on the ground plates and adjust the shape of the shielding section, since it is essential for the grounding contact portions formed on the side ends of the ground plates to have flexibility, there is restriction in designing of the shapes of the shielding sections. Therefore, it is not easy to provide a shielding section that enables to obtain preferred impedance. For this reason, according to Patent Reference, it is difficult to stably transmit signals.

In view of the above-described issues of the conventional intermediate electrical connector, an object of the present invention is to provide an intermediate electrical connector and an electrical connector assembled component, whereby it is possible to securely shield the contact parts where the signal terminals of the intermediate electrical connector and the mating signal terminals of the mating connector contact to each other, to easily adjust the impedance at the contact parts between the terminals, and to achieve stable signal transmission.

Further objects and advantages of the present invention will be apparent, from the following description of the present invention.

SUMMARY OF THE PRESENT INVENTION

According to a first aspect of the present invention, an intermediate electrical connector includes intermediate connecting members. Each intermediate connecting member includes a flat blade, in which a plurality of strip-like terminals is held by a base member. To the intermediate electrical connector, a mating connector or a mating connecting member, which may include a circuit board, is connected from a side of one ends of the terminals and from a side of the other ends.

According to the first aspect of the present invention, in the intermediate electrical connector, the terminals includes two types of terminals, signal terminals and ground terminals. The plate surfaces of the terminals are disposed in a widthwise direction of the blade, having the plate surfaces of the terminals horizontal to the plate surfaces of the blade. Each terminal includes a contact portion at least on one of the side of the one end and of the other end. The contact portions are provided for connecting to the mating connector connected from at least one of the sides, the side of the one ends and/or the side of the other ends. The one ends and the other ends are respectively joined by joining sections.

According to the first aspect of the present invention, in the intermediate electrical connector, each blade includes two ground plates. The ground plates are provided on both sides of the terminals and extend in the arrangement range of the terminals in the widthwise direction of the blade. The two ground plates are composed of a first ground plate and a second ground plate, which are provided on two plate surfaces of the strip-like terminals. The first ground plate is provided on a side of one plate surfaces, which are contact surfaces of the contact portions. The second ground plates are provided on surfaces of the terminals opposite the contact surfaces.

According to the first aspect of the present invention, in the intermediate electrical connector, the ground plate is provided in the range that corresponds to the joining sections of the terminals and contact with the joining sections of the ground terminals, corresponding to the ground terminals in the widthwise direction of the blade. The second ground plate is provided in the range that corresponds to the contact portions and the joining sections of the terminals. Further, the second ground plate contacts with the joining sections of the ground terminals corresponding to the ground terminals in the widthwise direction of the blade.

According to the first aspect of the present invention, in the intermediate electrical connector, each blade includes the first ground plate and the second ground plate. Among the first ground plate and the second around plate, it is configured such that the second ground plate shields not only the range that Corresponding to the joining sections of the terminals, but also the range that corresponds to the contact portions, from the side opposite the contact surfaces of the contact portions.

According to the conventional intermediate electrical connector described above, the mating contact portions formed on the mating terminals are shielded by the mating ground plate from the opposite side to the contact surfaces of the mating contact portions. On the other hand, according to the first aspect of the present invention, in a state that the connectors are fitted, the contact parts where the contact portions and the mating contact portions contact each other are shielded by the second ground plate and the mating ground plate from both sides in the plate thickness direction of the blade. As a result, in the contact parts, it is possible to transmit signals without influence from noises from outside.

According to the first aspect of the present invention, the second ground plate and the ground terminals are provided as separate members. The second ground plate contact with connecting sections of the ground terminals. In other words, it is not necessary to form flexible grounding contact portions such as conventional ones on the second ground plate. Therefore, upon designing the second ground plate, there is no restriction in the shapes of parts that correspond to the signal contact portions of the signal terminals, so that it is possible to freely design the shapes of the parts. As a result, it is possible to easily adjust the impedance by forming the shapes of the parts that correspond to the signal contact portions in shapes so as to achieve desired impedance matching at the contact portions between the signal terminals.

According to a second aspect of the present invention, each ground plate includes protrusions that protrude in the thickness direction of the blade in a state of not contacting with the contact portions. It is possible to adjust a distance between the protrusions and the contact portions according to the desired impedance at the contact parts between the contact portions and the mating terminals of the mating connector.

As described above, according to the second aspect of the present invention, there are provided the protrusions on the second ground plate. With this configuration, it is possible to adjust the distance between the protrusions and the contact portions according to the protruding amount of the protrusions. Therefore, if the distance is set by adjusting the protruding amount of the protrusions according to the desired impedance at the contact parts upon designing the second ground plate, it is possible to easily make the second ground plate that can achieve the desired impedance.

According to a third aspect of the present invention, an electrical connector assembled component includes the intermediate electrical connector of the first and the second aspects of the present invention and the mating connector thereof, which is a mating connecting member to be connected to the intermediate electrical connector.

According to the third aspect of the present invention, in the electrical connector assembled component, the mating connector is provided to be mounted on a circuit board corresponding to the intermediate connecting member of the relay electrical connector. The mating connector includes a plurality of strip-like mating terminals, mating ground plates, and a housing. The plurality of strip-like mating terminals is provided so as to connect corresponding to the plurality of terminals of the intermediate connecting member. The mating ground plates extend over the arrangement range of the plurality of the mating terminals in the widthwise direction of the blade. The housing holds the mating terminals and the mating ground plates.

According to the third aspect of the present invention, in the electrical connector assembled component, the mating terminals are composed of two types of terminals, mating signal terminals and mating ground terminals. The mating terminals are disposed in the widthwise direction of the blade, such that plate surfaces thereof are horizontal to the plate surfaces of the blade. Each mating terminal includes a mating contact portion and a mating connecting portion.

According to the third aspect of the present invention, in the electrical connector assembled component, the mating contact portions are provided on one ends of the mating terminals to be connected to the terminals of the intermediate connecting member. The mating connecting portions are provided on the other ends of the mating terminals to be connected to the circuit board. The mating contact portions and the mating connecting portions are respectively joined by joining sections.

According to the third aspect of the present invention, in the electrical connector assembled component, the mating ground plates are provided on a side opposite the contact surfaces of the mating contact portions of the mating terminals. The mating ground plates are provided corresponding to the mating contact portions and the mating joining sections of the mating terminals. The mating ground plates contact with the mating joining sections of the mating ground terminals at positions that correspond to the mating ground terminals in the blade's widthwise direction.

According to the third aspect of the present invention, similarly to the first and the second aspect of the present invention, in a state that the connectors are fitted, the contact parts where the contact portions of the signal terminals and the mating contact portions of the mating signal terminals contact are shielded from the both sides in the blade's thickness direction by the second ground plate and the mating ground plate. Therefore, signals are transmitted without influence of noises from outside. In addition, similarly to the first and the second aspects of the present invention, the second ground plate and the ground terminals are provided as separate members. Therefore, it is easy to adjust the impedance by forming the parts of the ground plates, which correspond to the signal contact portions of the signal terminals, in preferred shapes.

According to a fourth aspect of the present invention, the mating connectors are provided in rows arranged corresponding to the intermediate connecting members of the relay electrical connector, which is arranged in the blade's thickness direction. The plurality of mating connectors is connected to each other by connecting members or joining members. The connecting members extend in the arrangement direction of the plurality of mating connectors. The connecting members are carriers that can be connected to the plurality of mating ground plates. The carriers can connect the plurality of mating connectors via the mating ground plates respectively held by the housings of the mating connectors without being cut off from the mating ground plates.

As described above, according to the electrical connector assembled component, the plurality of mating connectors is joined by the connecting members. The connecting members are connected to the mating ground plates, which are respectively held by the housings of the respective mating connectors. Therefore, since the respective ground plates are electrically connected, it is possible to improve the grounding effect.

Moreover, since the plurality of mating connectors is connected by the connecting members, it is easy to maintain the precision of physical relationships among the mating connectors. Therefore, it is possible to securely connect the intermediate electrical connector to the mating connectors. Furthermore, the carriers have relatively large width and high strength, so that the carriers are suitable as the connecting members. In addition, effectively using the carriers as the connecting members without cutting off the carriers from the ground plates so as also not to waste, it is possible to restrain the manufacturing cost.

As described above, according to the present invention, it is possible to shield the contact parts, where the signal terminals of the intermediate electrical connector and the mating signal terminals of the mating connectors contact, from both sides in the blade's widthwise direction by the second ground plate of the electrical connector and the mating ground plate of the mating connector.

Therefore, it is possible to securely protect the contact parts from influence of noises from outside. Moreover, the second ground plates and the ground terminals are separate members. As for the second ground plates, it is possible to freely design the parts that correspond to the signal contact portions of the signal terminals. Therefore, forming the second ground plates in a shape so as to be able to match impedance at the contacting parts between the signal terminals, it is possible to easily adjust the impedance. As a result, it is achievable to stably transmit signals.

BRIEF DESCRIPTION OF THE DRAWINGS

FIGS. 3(A) and 3(B) are perspective views showing a intermediate connecting member of the intermediate electrical connector according to the embodiment, of the present invention, wherein FIG. 3(A) shows the intermediate connecting member in a finished state and FIG. 3(B) shows the intermediate connecting member a state that members thereof are separated from each other;

FIGS. 4(A) and 4(B) are perspective views showing a blade of the intermediate electrical connector according to the embodiment of the present invention, wherein FIG. 4(A) shows the blade viewed from a side of an inner ground plate and FIG. 4(B) shows the blade viewed from a side of an outer ground plate;

FIGS. 7(A) and 7(B) are sectional views showing the intermediate connecting member of the intermediate electrical connector taken at surfaces perpendicular to a widthwise direction of the blade according to the embodiment of the present invention, wherein FIG. 7(A) is the sectional view taken at the surface where ground terminals are present and FIG. 7(B) is the sectional view taken at the surface where signal terminals are present;

FIGS. 8(A), 8(B), and 8(C) are perspective views showing a step of arranging terminals in manufacturing the blade of the intermediate electrical connector according to the embodiment of the present invention, wherein FIG. 8(A) shows one terminal group, FIG. 8(B) shows the other terminal group, and FIG. 8(C) shows a state that the one terminal group and the other terminal group are put together;

FIGS. 11(A) and 11(B) are sectional views showing the intermediate electrical connector, taken at a surface perpendicular to the widthwise direction of the blade, more specifically which is taken at a plate surface of a support member according to the embodiment of the present invention, wherein FIG. 11(A) shows the intermediate electrical connector in a normal state, and FIG. 11 (B) shows a section showing the intermediate electrical connector in a floating state;

FIGS. 13(A), 13(B), and 13(C) are perspective views of mating ground plates, wherein FIG. 13(A) is a perspective view showing one mating ground plate, FIG. 13(B) is a perspective view of the other mating ground plate, and FIG. 13(C) is a perspective view showing the one and the other mating ground plates with a plurality of mating terminals thereof;

FIGS. 14(A), 14(B), and 14(C) are sectional views showing the mating connector, wherein FIG. 14(A) is a sectional view showing the mating connector taken at a surface perpendicular to the up-and-down direction, FIG. 14(B) is a sectional view showing the mating connector, taken at a surface perpendicular to the arrangement direction of the terminal, more specifically which is taken at the mating ground terminals, and FIG. 14(C) is a sectional view showing the mating connector taken at a surface perpendicular to the terminals' arrangement direction, more specifically which is taken at mating signal terminals;

DETAILED DESCRIPTION OF THE PREFERRED EMBODIMENTS

Hereunder, embodiments of the present invention will be described with reference to the accompanying drawings.

Figure 1:
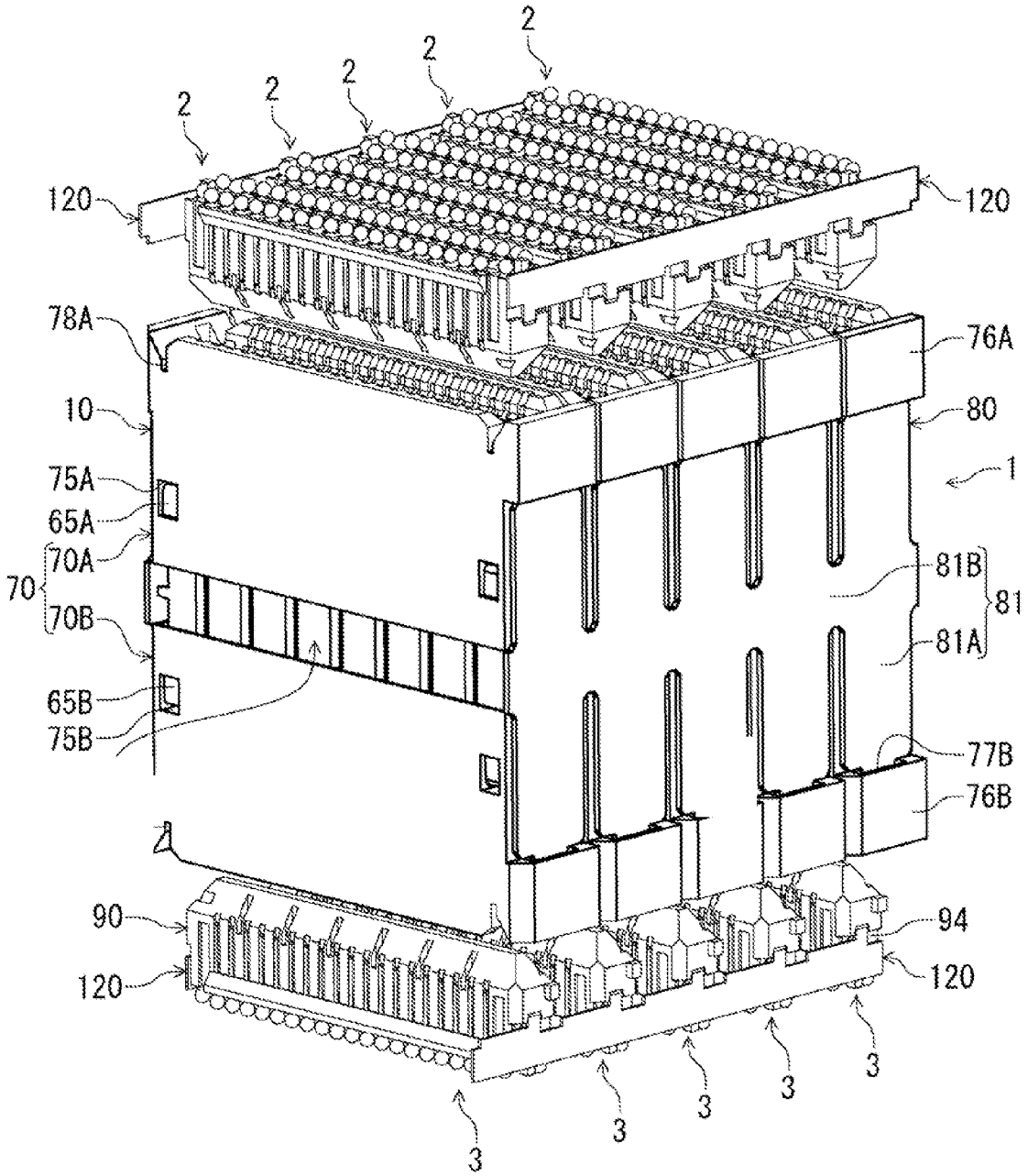
FIG. 1 is a perspective view showing an intermediate electrical connector according to a embodiment of the present invention, which is shown with mating connectors thereof before fitting to the intermediate electrical connector.
Figure 2:
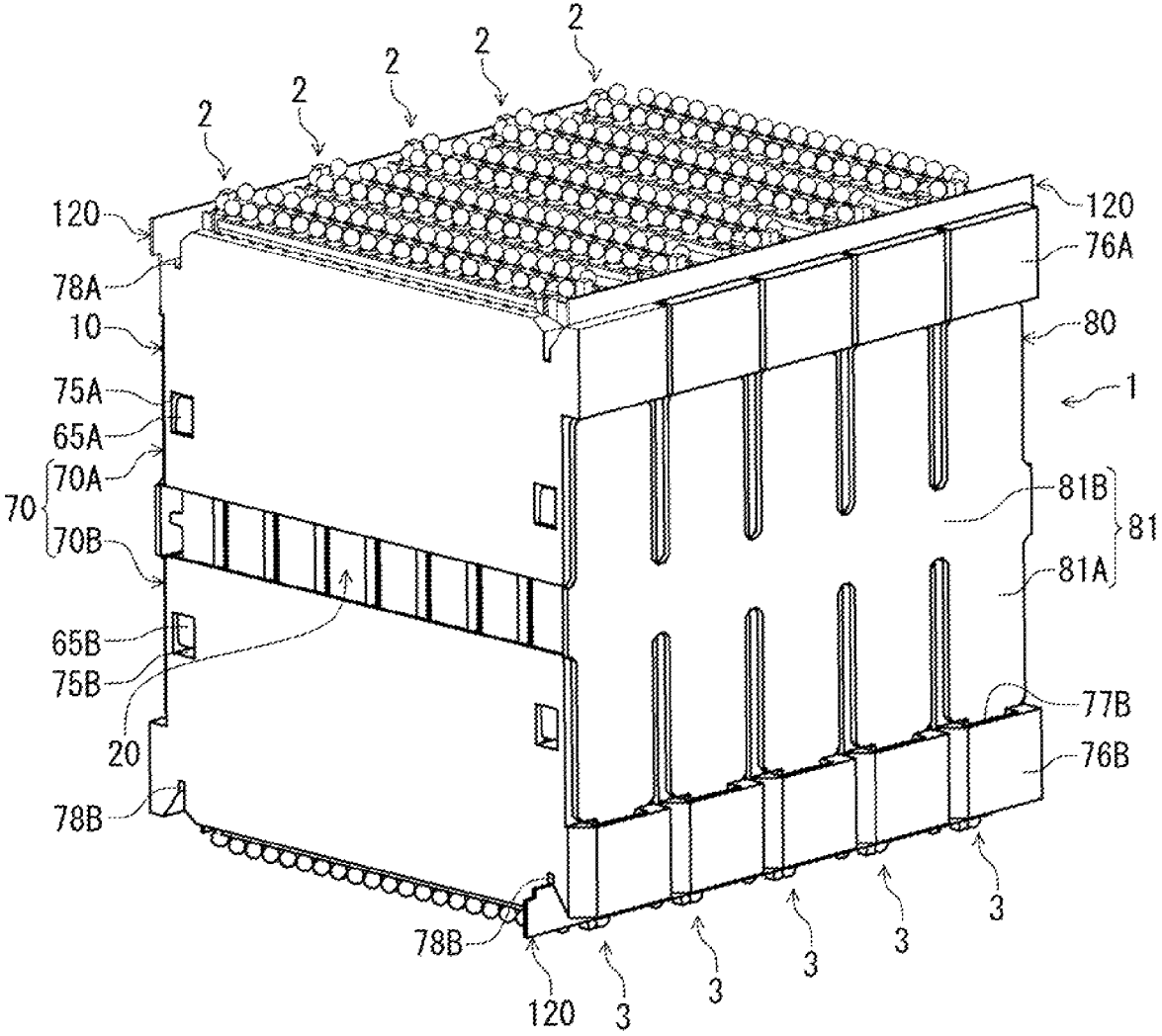
FIG. 2 is a perspective view showing the intermediate electrical connector according to the embodiment of the present invention, which is shown with the mating connectors thereof in a state that the mating connectors are fitted to the intermediate electrical connector.

FIG. 1 is a perspective view showing an intermediate electrical connector according to the embodiment of the invention, which shows with mating connectors thereof, in a state before fitting to the intermediate electrical connector. FIG. 2 is a perspective view showing the intermediate electrical connector of FIG. 1 and the mating connectors thereof in their fitted states.

As shown in FIG. 1, to the intermediate electrical connector 1 of the embodiment (hereinafter simply referred to as "relay connector 1"), connected are mating connecting bodies, mating connectors 2 and 3, from thereabove and thereunder, respectively. The intermediate electrical connector relays and connects between the mating connectors 2 and 3. The mating connectors 2 and 3 are electrical connectors to be used on circuit boards, have the same shapes, and are to be connected to circuit boards (not illustrated) that are different from each other.

In the embodiment, as shown in FIG. 1, five mating connectors 2 disposed on one circuit board and five mating connectors 3 disposed on another circuit board are connected via the relay connector 1 having five intermediate connecting members. As for the intermediate connecting members, explanation will be provided below.

The relay connector 1 shown in FIG. 1 includes a plurality of intermediate connecting members and two support members. The plurality of intermediate connecting members is to be connected to the mating connectors 2 and 3. The two support members are made of sheet metal, arrange the plurality of intermediate connecting members 10 and support them together. According to the embodiment, there are provided five intermediate connecting members are provided, so as to respectively correspond to the plurality of mating connectors 2 and 3. Those five intermediate connecting members 10 are arranged at equal intervals being close to each other in one direction horizontal to surfaces of the circuit boards.

Figure 3:
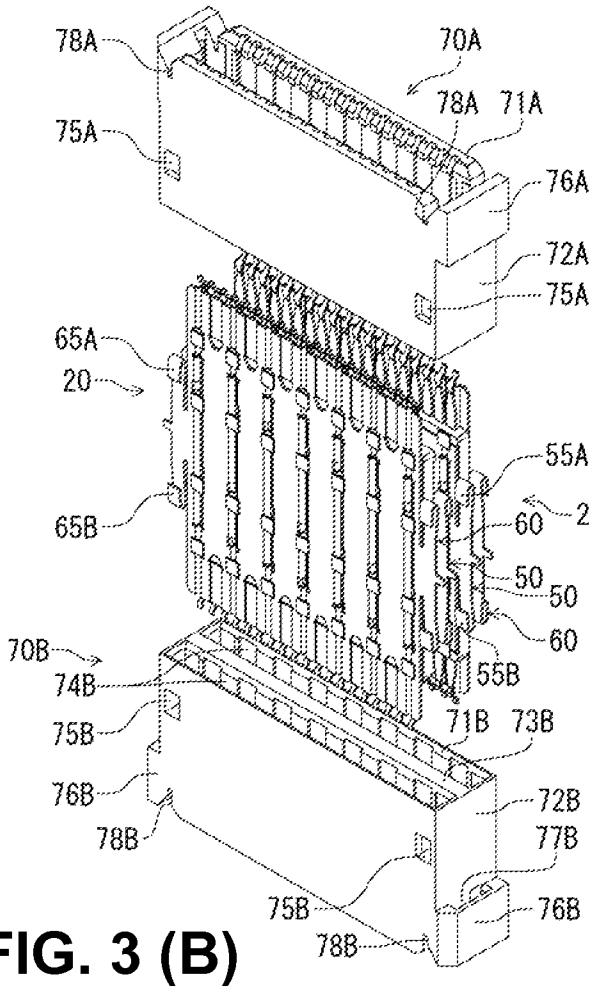
Figure 3:
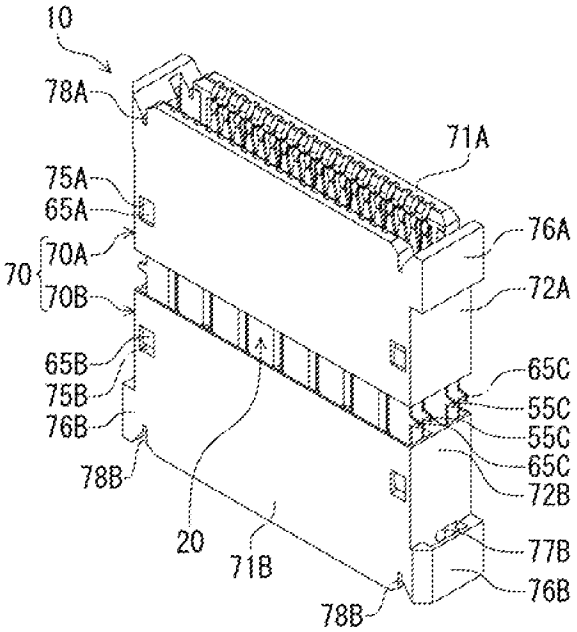

As shown in FIG. 3(B), each intermediate connecting member 10 has the same shape, and includes two blades 20. The two blades 20 face each other in a pair, being symmetrical about an arrangement direction of the intermediate connecting members 10. Each pair of the blades is held in and by the blade holding bodies 70, which will be described later (See also FIGS. 6, 7(A), and 7(B)). The space opened upward between the blades 20 in an upper part of the intermediate connecting member 10 is formed as an upper receiving section 11 (See FIGS. 7(A) and 7(B)) for receiving a fitting wall section 92 of the mating connector, which will be described later. On the other hand, the space opened downward between the blades 20 in an lower part of the intermediate connecting member 10 works as a lower receiving section 12 (See FIGS. 7(A) and 7(B)) for receiving a fitting wall section 92 of the mating connector 3, which will be described later.

Figure 7:
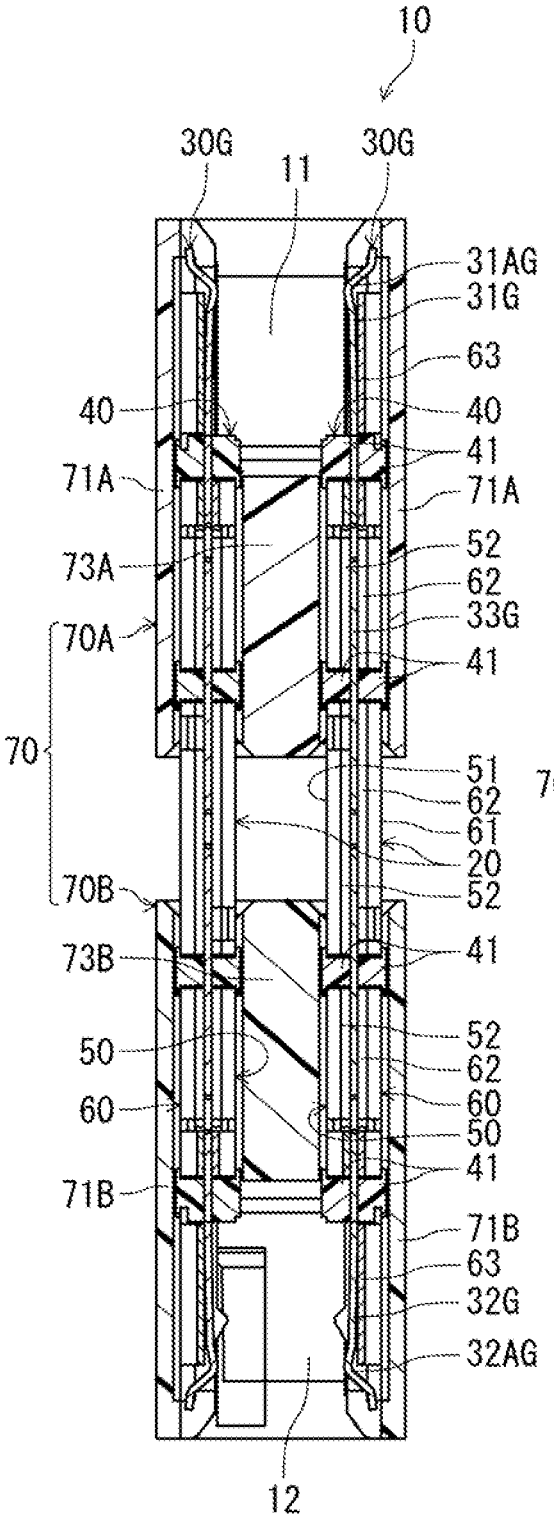
Figure 7:
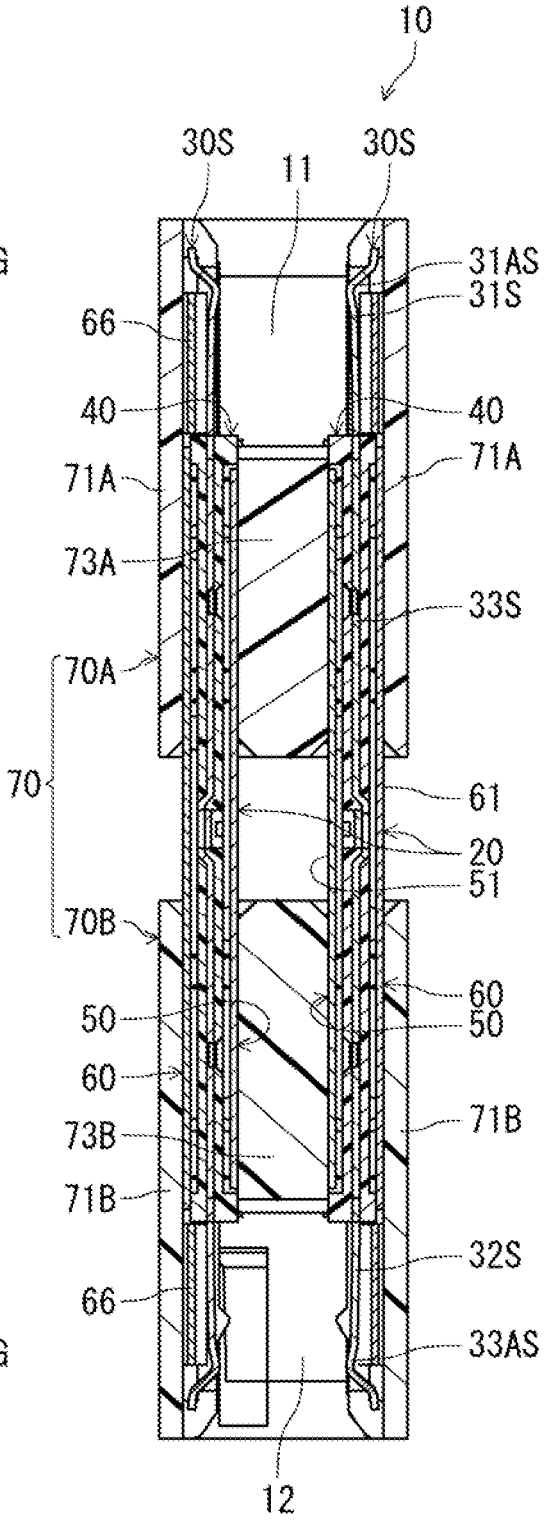

As shown in FIGS. 4(A) and 4(B), each blade 20 includes a plurality of terminals 30, a substrate 40, a first grounding plate 50, and a second grounding plate 60 (See also FIGS. 7(A) and 7(B)). The plurality of terminals 30 is arranged at equal intervals in a connector's widthwise direction (identical to a widthwise direction of the blade), which is perpendicular to the arrangement direction of the intermediate connecting members 10. The substrate 40 is made of resin and holds the plurality of terminals 30 being integrally molded therewith.

The first grounding plate 50 is attached on a side of one sheet surface of the substrate 40 ("first" herein corresponds to "inner-side", which will be described later). The second grounding plate 60 ("second" herein corresponds to "outer-side", which will be described later) is attached on a side of the other sheet, surface. Hereinafter, in a pair of two blades 20, a side where surfaces thereof face each other is referred to as "inner side", and an opposite side thereof is referred to as "outer side". In addition, the first grounding plates 50 provided on the inner side of the blade 20 will be referred to as "inner grounding plate 50", and the second grounding plates provided on the outer side of the blade 20 will be referred to as "outer grounding plate 60".

As shown in FIG. 4(A), the plurality of terminals 30 includes signal terminals 30S and grounding terminals 30G. In each blade 20, the terminals 30 are arranged so as to have each grounding terminal 30G disposed between two signal terminals 30S that are adjacent to each other (See also 8(C)). According to the embodiment, the two adjacent signal terminals 30S transmit high-speed differential signals that are paired to each other. Hereunder, when it is not necessary to specially distinguish between the signal terminals 30S and the grounding terminals 30G, those terminals are comprehensively referred to as "terminals 30".

Each terminal is made by partially bending a strip-like metal piece that, extends in a connector's fitting direction, i.e., in an up-and-down direction. Each terminal 30 includes an upper elastic arm 31 that extends upward from an upper end of the substrate 40, a lower elastic arm 32 extending downward from a lower end of the substrate 40, and a joining section 33 that extends in the up-and-down direction and joins between the upper elastic arm 31 and the lower elastic arm 32 (See FIGS. 7(A), 7(B), and 8(C)). Hereunder, in the respective parts of the terminals 30, when it is necessary to distinguish between the signal terminals 30S and the grounding terminals 30G, those parts will be described affixing "S" or "G" to the respective reference numerals.

The upper elastic arms 31 and the lower elastic arms 32 can elastically displace in their respective sheet thickness directions. On an tipper end side of the upper elastic arms 31 and lower end side of the lower elastic arms 32, there are formed upper contact sections 31A and lower contact sections 32A, respectively. The upper and lower contact sections 31A and 32A are bent so as to protrude inward (towards a side where the two blades face each other) in the sheet thickness direction. The upper contact sections 31A and the lower contact sections 32A elastically contact with terminals 100 of the mating connectors 2 and 3 ("mating terminals 100", which will be described later).

Figure 8:
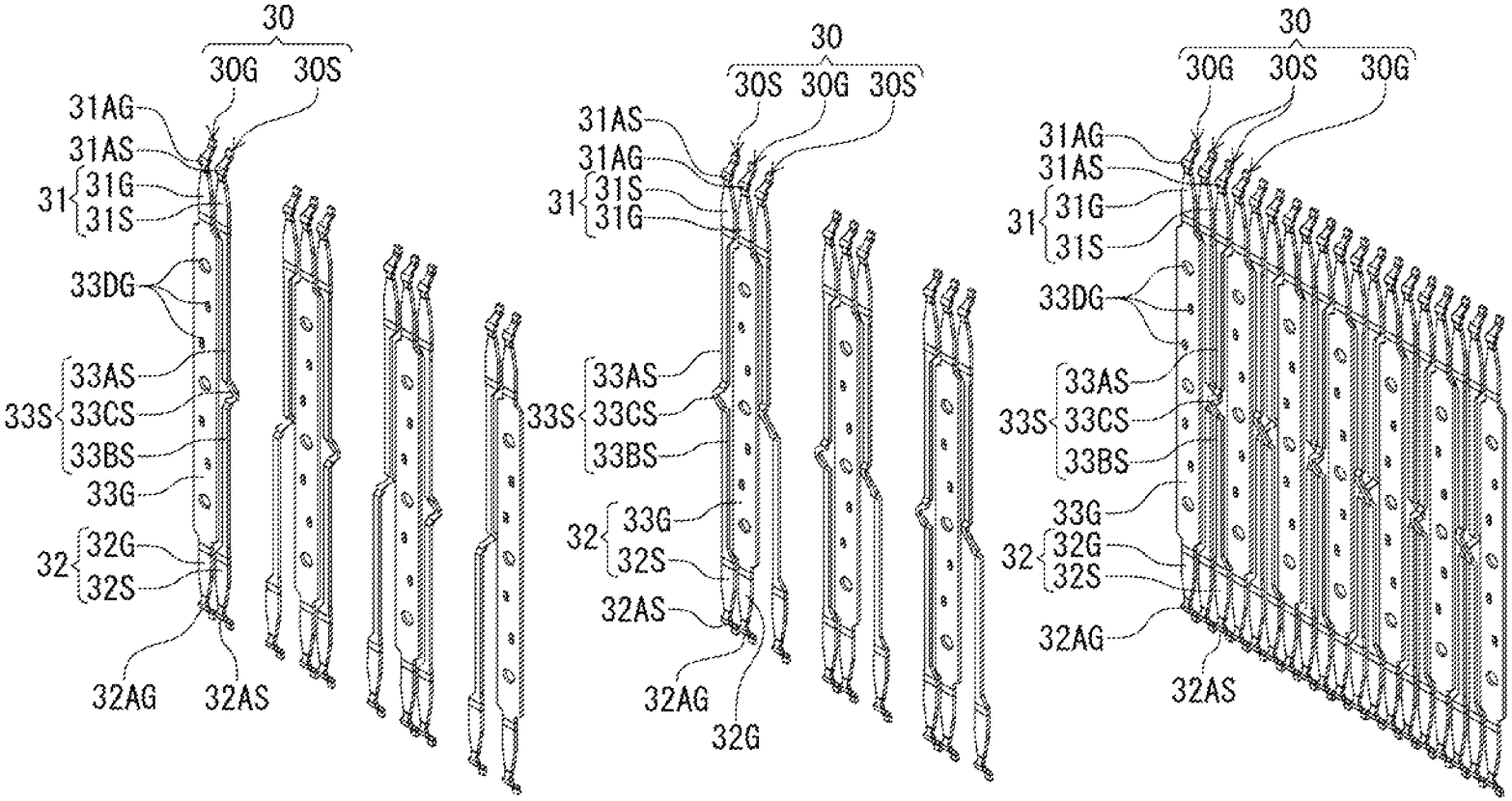

As shown in FIGS. 7(A), 7(B), and 8(C), the joining sections 33 join the upper elastic arms 31 and the lower elastic arms 32, and thereby indirectly join between the upper contact sections 31A and the lower contact sections 32A. As shown in FIG. 8(C), a joining section 33S of each signal terminal 30S includes an upper joining section 33AS, a lower joining section 33BS, and a center joining section 33CS. The upper joining section 33AS extends straight over generally upper half part of the joining section 33S. The lower joining section 33BS extends straight over a lower half part of the joining section 33S. The center joining section 33CS is a bent section provided at a center part of the joining section 33S in an up-and-down direction thereof. The center joining section 33CS joins between the upper joining section 33AS and the lower joining section 33BS. The signal terminals 30S that are adjacent to each other are paired and there is provided a plurality of such pairs. The plurality of such pairs includes cross pairs and straight pairs.

In each cross pair, the center joining sections 33CS cross each other at a center part thereof in the up-and-down direction. In each straight pair, the center joining sections 33CS are bent at their center parts so as to be close to each other. In each straight pair, the center joining sections 33CS look as if cross each other when viewed in the sheet's thickness direction of the signal terminals 30S. The cross pairs and the straight pairs are alternately disposed having a grounding terminal therebetween in the terminals' arrangement direction, thereby reducing cross talks between adjacent pairs. Each pair's shape is well known, so that detailed description is omitted.

As shown in FIG. 8(C), a joining section 33G of each grounding terminal 30G is formed to be wider than the joining section of each signal terminal 30S. Each joining section 33G extends straight as a whole. Each joining section 33G includes through holes 33DG, which are provided in a plurality in the up-and-down direction and penetrate in the sheet's thickness direction. As will be described later, into the through holes 33DG, protruding portions 52A and 62A of the grounding plates 50 and 60 are fitted. With this configuration, the inner grounding plate 50 and the outer grounding plate 60 can contact each other and in turn electrically connect to each other.

Figure 5:
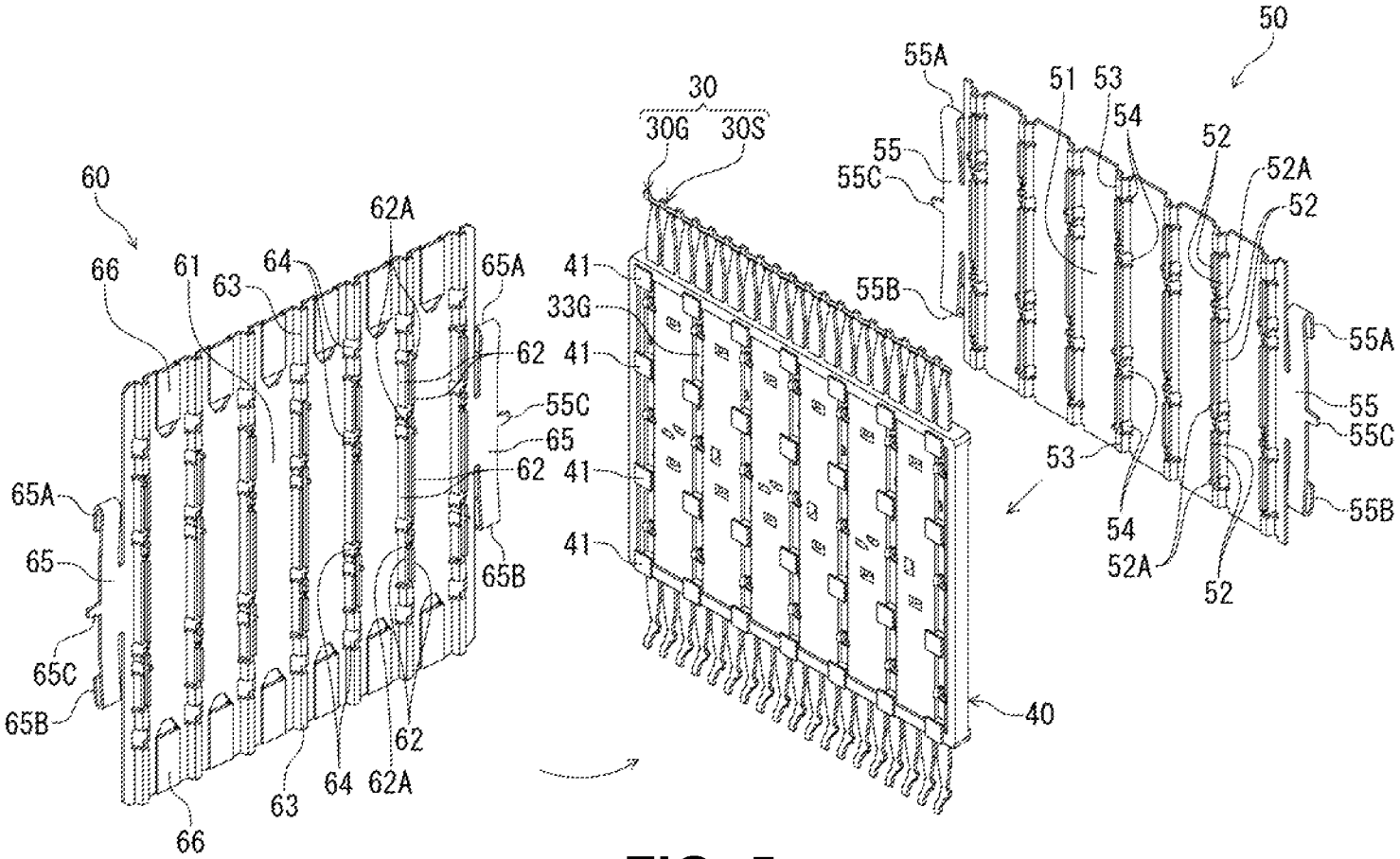
FIG. 5 is a perspective view showing of the intermediate electrical connector in a state that the inner ground plate and the outer ground plate are detached from the blade according to the embodiment of the present invention.

As shown in FIG. 5, the substrate 40 extends over a range that includes the arrangement range of the terminals 30 in the terminal arrangement direction (blade's widthwise direction). The substrate 40 has a quadrilateral shape extending over the range of the joining section 33 in the up-and-down direction (See also FIGS. 7(A) and 7(B)). On the both sheet surfaces of the substrate 40 (surfaces perpendicular to the sheet thickness direction of the substrate 40), corresponding to the grounding terminal 30G in the terminal arrangement direction, there are formed holding protruding portions 41 for holding the grounding plates 50 and 60 at an upper end, a lower end, and two middle positions between the upper end and the lower end.

The holding protruding portions 41 protrude from the sheet surfaces of the substrate 40 (See also FIGS. 4(A) and 4(B)). Moreover, corresponding to the grounding terminals 30G, in area other than the plurality of holding protruding portions 41 in the up-and-down direction, the sheet surfaces of the joining sections 33G of the grounding terminals 30G are exposed. Here, the holding protruding portions 41 shown in FIG. 5 have quadrilateral shapes when viewed in the sheet's thickness direction of the substrate 40. However, the holding protruding portions 41 are formed in the shapes when the holding protruding portions 41 are melted and are deformed upon attaching the grounding plates 50 and 60 to the substrate 40 by ultrasonic welding (See also FIGS. 4(A) and 4(B)). Before the ultrasonic welding, the holding protruding portions 41 have shapes of cylindrical protruding portions.

As described above, the inner grounding plates 50 are provided on surfaces of the substrates 40 that face each other inward in the intermediate connecting member 10, i.e., a side of surfaces of the terminals 30 where the contact sections 31A and 32A are provided. That is, the inner grounding plates 50 are provided on a side of protruding surfaces of the terminals 30 (See FIG. 4(A)). The inner grounding plate 50 is made of a sheet metal piece, and formed by bending work and press work. Each inner grounding plate 50 includes an inner grounding main body 51 having a quadrilateral shape, and projecting side sections 55. The projecting side sections 55 are provided in the middle of the inner grounding main body 51 in the up-and-down direction on both outer sides of the inner grounding main body 51 in the terminals' arrangement direction (blade's widthwise direction).

The inner grounding main body 51 has generally the same dimension as the substrate 40 in the terminals' arrangement direction and extends over the range of the terminal arrangement. In the up-and-down direction, the inner grounding main body 51 extends over the range where the joining sections 33 are present in the up-and-down direction (See FIGS. 7(A) and 7(B)).

Moreover, as shown in FIG. 5, the inner grounding main body 51 has inner protruding thin contact sections 52 within the range corresponding to exposed surfaces of the joining sections 33G of the grounding terminals 30G from the substrate 40. The inner protruding thin contact sections 52 are bent towards the exposed surfaces in the sheet thickness direction of the inner grounding main body 51, and extend in the up-and-down direction (See also FIG. 6).

As shown in FIG. 5, the inner protruding thin contact sections 52 are formed by cutting and lifting a part of the inner grounding main body 51 corresponding to the ranges of surfaces to expose. The inner protruding thin contact sections 52 contact with sheet surfaces of the joining sections 33G of the grounding terminals 30G at their edges that extend in the up-and-down direction (sheet thickness surfaces) (See also FIG. 6). The inner protruding thin contact sections 52 are provided in two for each exposed surface in one grounding terminal 30G. The two inner protruding thin contact sections 52 extend in the up-and-down direction in a state that sheet surfaces thereof face each other while being adjacent to each other.

As shown in FIG. 5, the inner protruding thin contact sections 52 have inner protruding portions 52A, corresponding to the through holes 33D of the grounding terminals 30G. When the inner grounding plates 50 are attached to one sheet surface (inner surface) of the substrate 40, the inner protruding portions 52A enter the corresponding through holes 33DG, and contact with the edges (sheet thickness surface) of the outer thin protruding contact sections 62 of the outer grounding plate 60 on the other sheet surface (outer surface).

The inner grounding main body 51 has inner contact protruding portions 53, which are formed by press work at upper ends and lower ends corresponding to the grounding terminals 30G in the terminals' arrangement direction. The inner contact protruding portions 53 protrude towards exposed surfaces of the joining sections 33G of the grounding terminals 30G. The inner contact protruding portions 53 are bent in the up-and-down direction in a shape of a trapezoid when viewed in the up-and-down direction. The inner contact protruding portions 53 are to contact with sheet surfaces of the joining sections 33G of the grounding terminals 30G at their protruding apexes.

As shown in FIG. 5, at positions of the grounding terminals 30G in the terminal arrangement direction, near the upper ends, near the lower ends, and between the inner thin protruding contact sections 52, in other words, corresponding to the holding protruding portions 41 of the substrate 40, there are formed inner holding holes 54 penetrating in the sheet thickness direction for inserting the holding protruding portions 41.

As shown in FIGS. 4(A) and 5, each projecting side section 55 has a sheet surface horizontal to the sheet surface of the inner grounding main body 51. The projecting side sections 55 are joined at their side edges to the middle parts of side edges of the inner grounding main body 51 in the up-and-down direction. The projecting side sections 55 are bent in the sheet thickness direction so as to fold back an upper end part downward and a lower end part upward. Each projecting side section 55 has an upper attachment section 55A and a lower attachment section 55B to be attached to the blade holding member 70.

In addition, at an outer edge of each projecting side section 55 (an edge part on a side that is not joined to the inner grounding main body 51), there is formed a pressure-welding protruding portion 55C, which protrudes outward in the blade's widthwise direction from a middle part thereof in the up-and-down direction. As will be described, the pressure-welding protruding portions 55C are to be welded with pressure to an inner surface of the support member 80 at their ends (See FIG. 10). Here, according to the embodiment, the pressure-welding protruding portions are formed as a part of the grounding plate, but the pressure-welding protruding portions may be formed on a member other than the grounding plates. For example, it is also possible to form the pressure-welding protruding portions as protruding portions that protrude outward in the connector's widthwise direction from a side surface of the substrate of the blade.

As described above, each outer grounding plate 60 is provided on the outer surface of the substrate 40, i.e., on a surface side opposite to the contact surface to the contact sections 31A and 32A of the terminals 30 in the two sheet surfaces that are front surface and back surface of each terminal 30 (See FIGS. 4(B), 7(A), and 7(B)). Each outer grounding plate 60 is made by bending work and pressing work on sheet metal member. The outer grounding plate 60 includes an outer grounding main body 61, and projecting side sections 65. The outer grounding main body 61 of the outer grounding plate 60 has a flat quadrilateral-like shape. The projecting side sections 65 are provided both side edges of the outer grounding main body 61 in the arrangement direction of the terminals 30 (blade's widthwise direction) and respectively extend in the up-and-down direction.

As well shown in FIG. 4(B), each outer grounding main body 61 has the same dimension as the inner grounding main body in the blade's widthwise direction and extends over the range where the terminals 30 are arranged. The outer grounding main body 61 has a larger dimension than that of the inner grounding main body 51 in the up-and-down direction. In other words, the outer grounding main body 61 faces not only the joining sections 33 of the terminals 30, but also upper elastic arms 31 and lower elastic arms 32 thereof (See also FIG. 7(A)).

As shown in FIG. 5, the outer grounding main body 61 includes outer contact thin protruding portions 62, outer protruding portions 62A, outer contact protruding portions 63, and outer holding holes 64, similarly to the inner contact thin protruding portions 52, the inner protruding portions 52A, inner contact protruding portions 53, and inner holding holes 54. The outer contact protruding portions 63 extend up to the ends of the outer grounding main body 61 in the up-and-down direction, i.e., to the range where the outer contact protruding portions 63 face the upper elastic arms 31G and the lower elastic arms 32G of the grounding terminals 30G.

Figure 4:
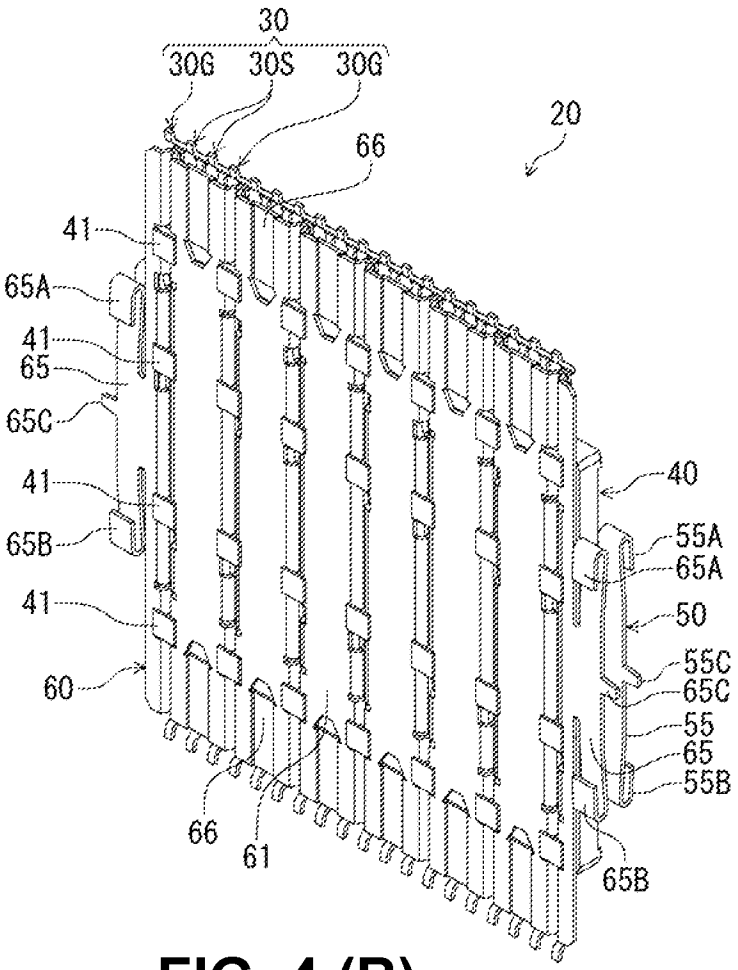
Figure 4:
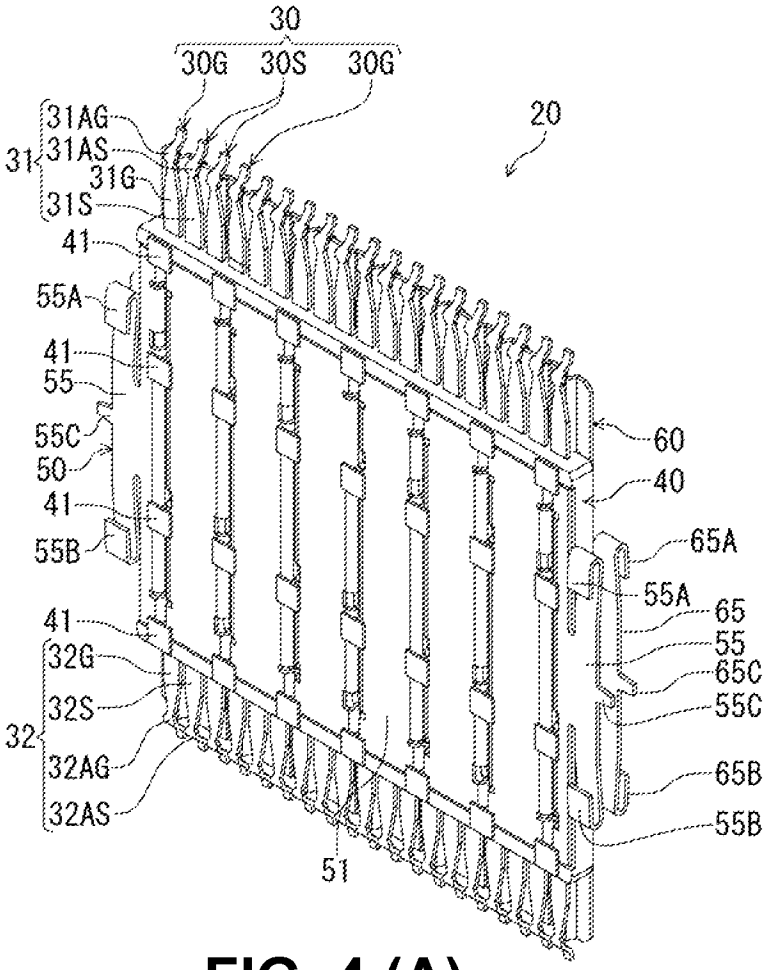

In this point, the outer contact protruding portions 63 are different from the inner contact protruding portions 53. In addition, projecting side sections 65 of the outer grounding plate 60 have the same shapes of the projecting side sections 55 of the inner grounding plate 50. As shown in FIG. 4, the projecting side sections 65 are provided so as to be symmetrical to the projecting side sections 55 about the sheet thickness direction of the blade 20.

Furthermore, as well shown in FIG. 5, the outer grounding main body 61 includes protruding pad-like sections 66. The protruding pad-like sections 66 protrude toward the elastic arms 31S and 32S in the sheet's thickness direction of the outer grounding main body 61 within the ranges corresponding to the elastic arms 31S and 32S of the signal terminals 30S that are adjacent to each other. In this point, the outer grounding main body 61 is different from the inner grounding main body 51.

Each protruding pad-like sections 66 is formed, for example, by press work, and has a quadrilateral shape when viewed in the sheet's thickness direction. The protruding pad-like sections 66 protrude towards the elastic arms 31S and 32S without contacting thereto (See also FIG. 7(B)). According to the embodiment, the protruding pad-like sections 66 have a function of adjusting the impedance at a part contacting with the contact sections 31AS and 32AS of the elastic arms 31S and 32S and the contact sections 101S of the mating signal terminals 100S to desired values (See FIG. 16(B)).

More specifically, according to the desired impedances at the contacting parts, the amount of protruding portion of the protruding pad-like sections 66, that is, the distance between the protruding top surfaces of the protruding pad-like sections 66 and the contact sections 31AS and 32AS of the elastic arms 31S and 32S is set.

As described above, according to the embodiment, depending on the amount of the protruding portion of the protruding pad-like sections 66, it is possible to adjust the distance between the protruding pad-like sections 66 and the contact sections 31AS and 32AS. Therefore, if the amount of protruding portions of the protruding pad-like sections 66 is adjusted to set the distance according to desired impedance upon designing the second grounding plate 60, it is possible to easily produce the second grounding plate 60 that can attain the desired impedance.

According to the embodiment, the protruding pad-like sections 66 protrude so as to be close to the elastic arms 31S and 32S. However, in order to obtain desired values of the impedance, it is also possible to form the protruding pad-like sections 66 in a direction to be away from the elastic arms 31S and 32S.

The grounding plates 50 and 60 are attached to the substrate 40 as will be described below. First, the holding protruding portions 41 (which have cylindrical shapes at this point) of the substrate 40 are inserted in the holding holes 54 and 64 of the grounding main bodies 51 and 61. Then, the grounding plates 50 and 60 are placed to contact with corresponding sheet surfaces of the substrate 40 (See the arrow mark in FIG. 5).

In this state, edges of the protruding thin contact sections 52 and 62 of the grounding plates 50 and 60 and the protruding top surfaces of the contact protruding portions 53 and 63 contact with their corresponding sheet surfaces of the joining sections 33G of the grounding terminals 30G. Moreover, the inner protruding portions 52A of the inner protruding thin contact sections 52 and the outer protruding portions 62A of the outer protruding thin contact sections 62 enter the through holes 33DG of the joining sections 33G from the opposite sides, and contact with edges of the outer protruding thin contact sections 62 and edges of the inner protruding thin contact sections 52.

Next, while keeping the state of contacting the grounding plates 50 and 60 by their surfaces to the substrate 40, ultrasonic welding is applied thereon. As a result, the cylindrical holding protruding portions 41 are melted, deform into quadrilateral shapes when viewed in the sheet thickness direction of the substrate 40, and then solidified. Accordingly, the holding protruding portions 41 engage with the grounding plates 50 and 60 and hold the grounding plates 50 and 60 (See FIG. 6).

Moreover, the portions where the inner protruding portions 52A contact with the edges of the outer protruding thin contact sections 62 and the portions where the outer protruding portions 62A and the inner protruding thin contact sections 52 are melted and solidified to be integrated to each other. Accordingly, the inner grounding plate 50 and the outer grounding plate 60 are electrically connected. According to the embodiment, the holding protruding portions 41 are ultrasonically welded and the parts where the protruding portions 52A and 62A contact with the protruding thin contact sections 62 and 52 are ultrasonically welded. The ultrasonic welding may not have to be applied in the both steps, but can be applied in only one of those steps.

As described above, according to the embodiment, the edges of the protruding thin contact sections 52 and 62 of the grounding plates 50 and 60 abut the both sheet surfaces of the joining sections 33G of the grounding terminals 30G. On the other hand, the protruding portions 52A and 62A of the grounding plates 50 and 60 are respectively welded to the edges of the protruding thin contact sections 62 and 52 of the grounding plates 60 and 50.

Figure 6:
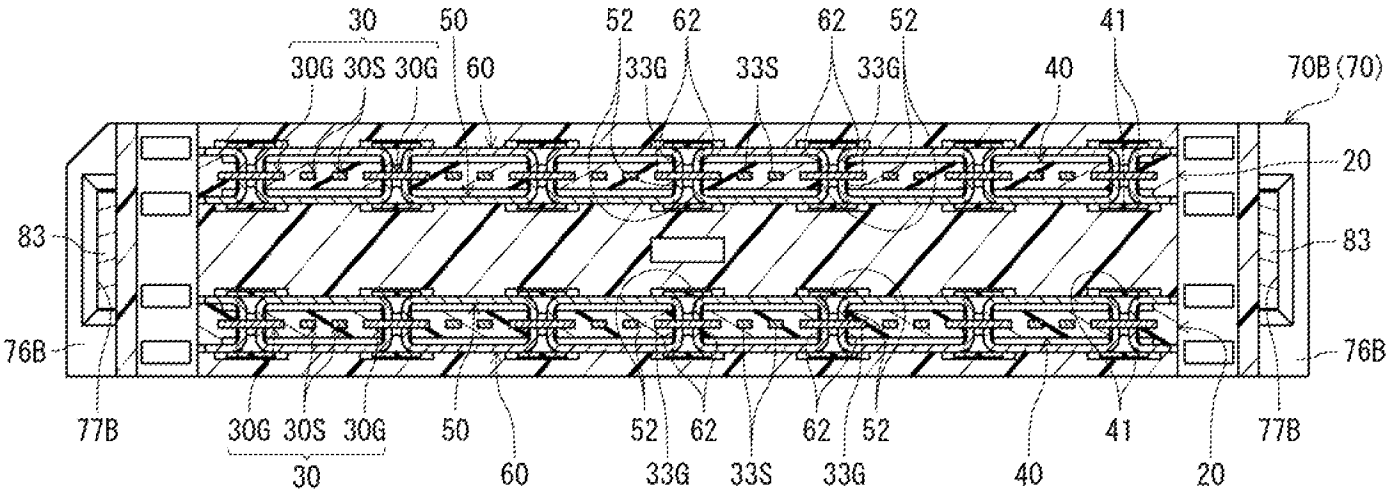
FIG. 6 is a sectional view showing the intermediate connecting member of the intermediate electrical connector taken along a surface perpendicular to an up-and-down direction thereof according to the embodiment of the present invention.

Therefore, as shown in FIG. 6, the joining sections 33S of each pair, which is composed of two signal terminals 30S that are adjacent to each other, are surrounded by the grounding plates 50 and 60 and the joining sections 33G of the two grounding terminals 30G when viewed in the up-and-down direction, and shielded from the outside. As a result, it is possible to securely prevent the respective pairs from cross talks between pairs. In addition, it is also possible to securely transmit signals without influence of noises from outside.

In addition, in the area that corresponds to the elastic arms 31 and 32 of the terminals 30 in the up-and-down direction, onto one sheet surfaces of the elastic arms 31G and 32G of the grounding terminals 30G (sheet surface on a side of the outer grounding plate 60), the contact protruding portions 63 of the grounding plate 60 contact by surface. Therefore, the elastic arms 31S and 32S of each pair, which is composed of the two adjacent signal terminals 30S, are shielded from outside on a side of the one sheet surface when viewed in the up-and-down direction.

As a result, as will be described later, in a state the connectors are fitted, in addition to the shielding of the mating signal terminals 100S by the mating grounding plates 110 of the mating connectors 2 and 3, it is possible to securely shield the contacting parts of the signal terminals 30S and 100S from outside.

The blade holding member 70 is made of an electrically insulating material. As shown in FIG. 1, the blade holding member includes an upper holding body 70A and a lower holding body 70B, which have the same shape. While being in a state the inner surfaces of the two blades 10 face each other, the blade holding member 70 houses and holds therein generally upper half of the both blades 10 with the upper holding body 70A thereof, and houses and holds therein generally lower half part of the both blades 10 with the lower holding body 70B thereof (See FIGS. 3(B), 7(A), and 7(B).

As shown in FIG. 1, the upper holding body 70A and the lower holding body 70B are disposed at certain distance away from each other in the up-and-down direction. Accordingly, middle parts of the blades 20 in the up-and-down direction are exposed in the range of the distance therebetween. The tips of the pressure-welding protruding portions 55C and 65C of the grounding plates 50 and 60 protrude outward in the connector's widthwise direction than the outer surfaces of the end walls 72A and 72B of the blade holding member 70, which will be described later (See FIGS. 3(A) and 10).

Hereunder, the configuration of the lower holding body 70B will be mainly described. As for the upper holding body 70A, the explanation will be omitted by affixing "A" in place of "B" of reference numerals of the respective parts of the lower holding section 70B.

As shown in FIG. 3(B), the lower holding body 70B includes two long walls 71B and two short walls 72B. The long walls 71B extend in the connector's widthwise direction (blade's widthwise direction). The short walls 72B extend in an arrangement direction of the intermediate connecting members 10 and joins ends of the long walls 71B. The lower holding body 70B generally has a shape of a rectangular parallelepiped as a whole.

Moreover, at a center of the lower holding body 70B in the arrangement direction, there is formed one dividing wall 73B. The dividing wall 73B extends in the connector's widthwise direction between the two long walls 71B and joins inner wall surfaces of the two end walls 72B. Being surrounded by the long walls 71B, the short walls 72B, and the dividing wall 73B and penetrating in the up-and-down direction, there are two spaces that form blade-housing holes 74B to respectively house the blades 20.

The long walls 71B include lower attachment holes 75B relatively near the both side edges and relatively near upper end in the up-and-down direction. The lower attachment holes 75B engage with the lower attachment sections 65B of the outer grounding plate 60 provided on the blades 20. The lower attachment holes 75B are through holes penetrating in the wall thickness direction.

Moreover, the dividing wall 73B includes lower attachment sections 55B (not illustrated) directly facing to the lower attachment holes 75B. The lower attachment holes 55B engage with the lower attachment sections 55B of the inner grounding plate 50 and are through holes penetrating in the wall thickness direction.

On a side surface (which includes an outer surface of the short walls 72B) of the lower holding body 70B, there is formed a lower supported portion 76B. The lower supported portions 76B protrude outward in the connector's widthwise direction from outer surfaces of the lower parts of the short walls 72B, and are supported by the lower supporting members 83 of the support members 80. Each lower supported portion 76B includes a slit-like lower hole to be supported 77B. The respective slit-like lower holes to be supported 77B extend perpendicular to the connector's widthwise direction and penetrate in the up-and-down direction. The lower holes to be supported 77B receive and house the lower supporting members 83 of the support members 80 from thereabove.

At a lower part of each lower holding body 70B, there is formed a slit-like end groove portion section 78B. The slit-like end groove portion sections 78B are opened downward near the ends in the connector's widthwise direction (slightly inner but adjacent to the lower supported portions 76B). As shown in FIG. 2, in a state that the connectors are fitted, the end groove portion sections 78B receive an upper part of a connecting member 120 of the mating connector 3, which will be described later.

The support members 80 are made by punching a sheet metal piece, keeping flat surfaces of the sheet metal piece. As shown in FIG. 2, the support members 80 are formed as flat members, which extend in the arrangement direction of the intermediate connecting members 10 and in the up-and-down direction.

Each support member 80 extends over the arrangement range of the relaying connecting bodies 10 in the arrangement direction, and over the generally the whole area of the intermediate connecting members 10 in the up-and-down direction, while having a slightly smaller dimension than the intermediate connecting members 10 in the direction. The support members 80 face the respective side surfaces of the intermediate connecting members 10 (See also FIG. 10). Accordingly, covering generally the whole area of the respective side surfaces of the intermediate connecting members 10 with the support members 80, it is possible to obtain satisfactory shielding effect.

As shown in FIG. 1, each support member 80 includes a main body 81, upper supporting members 82, and lower supporting members 83. Each main body 81 continues to extend in the arrangement direction and has its sheet surface exposed in a state of supporting the intermediate connecting members 10. The upper supporting members 82 extend upward from an upper edge of the main body 81 (See FIGS. 9(B) and 10). The lower supporting members 83 extend downward from a lower edge of the main body 81 (FIG. 10).

Each main body 81 includes strip-like sections 81A and relay sections 81B. The strip sections 81A are provided corresponding to the respective intermediate connecting members 10 in the arrangement direction, and cover side surfaces of the intermediate connecting members 10. The relay sections 81B are provided corresponding to spaces between the intermediate connecting members that are adjacent to each other in the arrangement direction, and join facing edges (edges extending in the up-and-down direction) of the strip sections 81A. The relay sections 81B are formed at center area of the strip-like sections 81A in the up-and-down direction, protruding from side edges of the strip-like sections in the arrangement direction. As well shown in FIG. 1, according to the embodiment, five strip-like sections 81A are connected with the relay sections 81B to be continuous in the arrangement direction.

Figure 9:
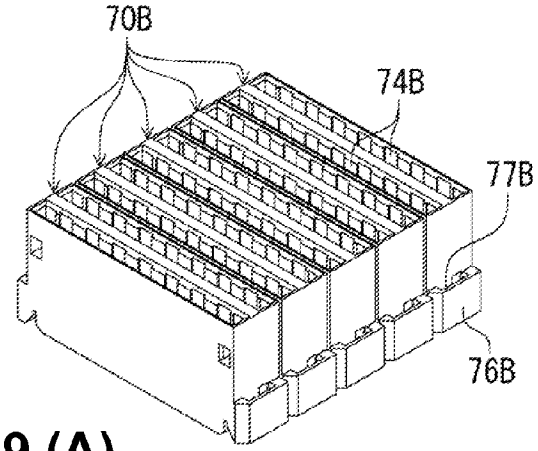
FIGS. 9(A) through 9(D) are perspective views showing the steps of assembling the intermediate electrical connector according to the embodiment of the present invention.
Figure 9:
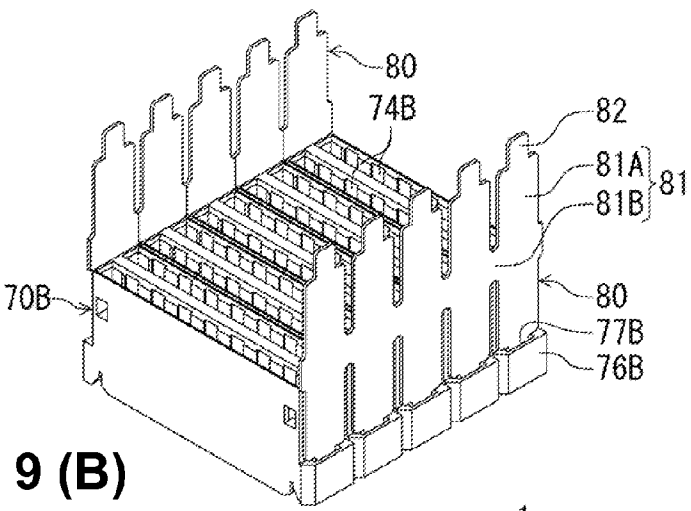
Figure 9:
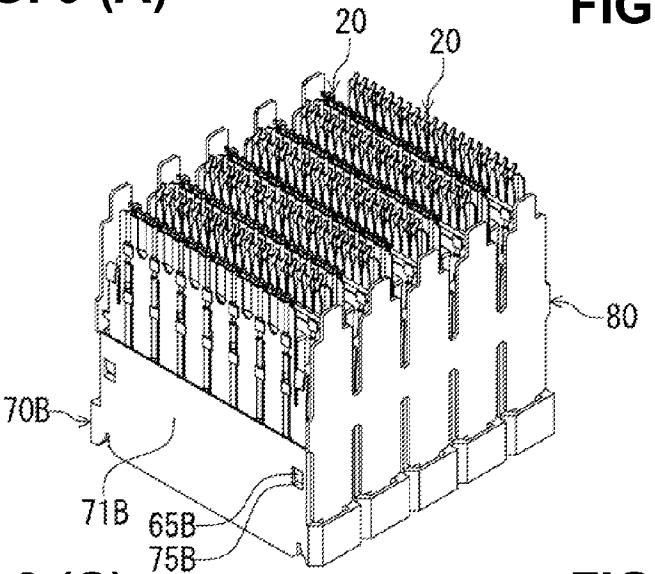
Figure 9:
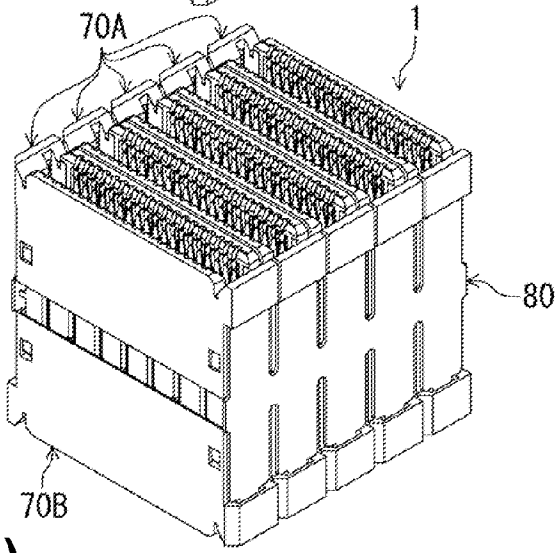
Figure 10:
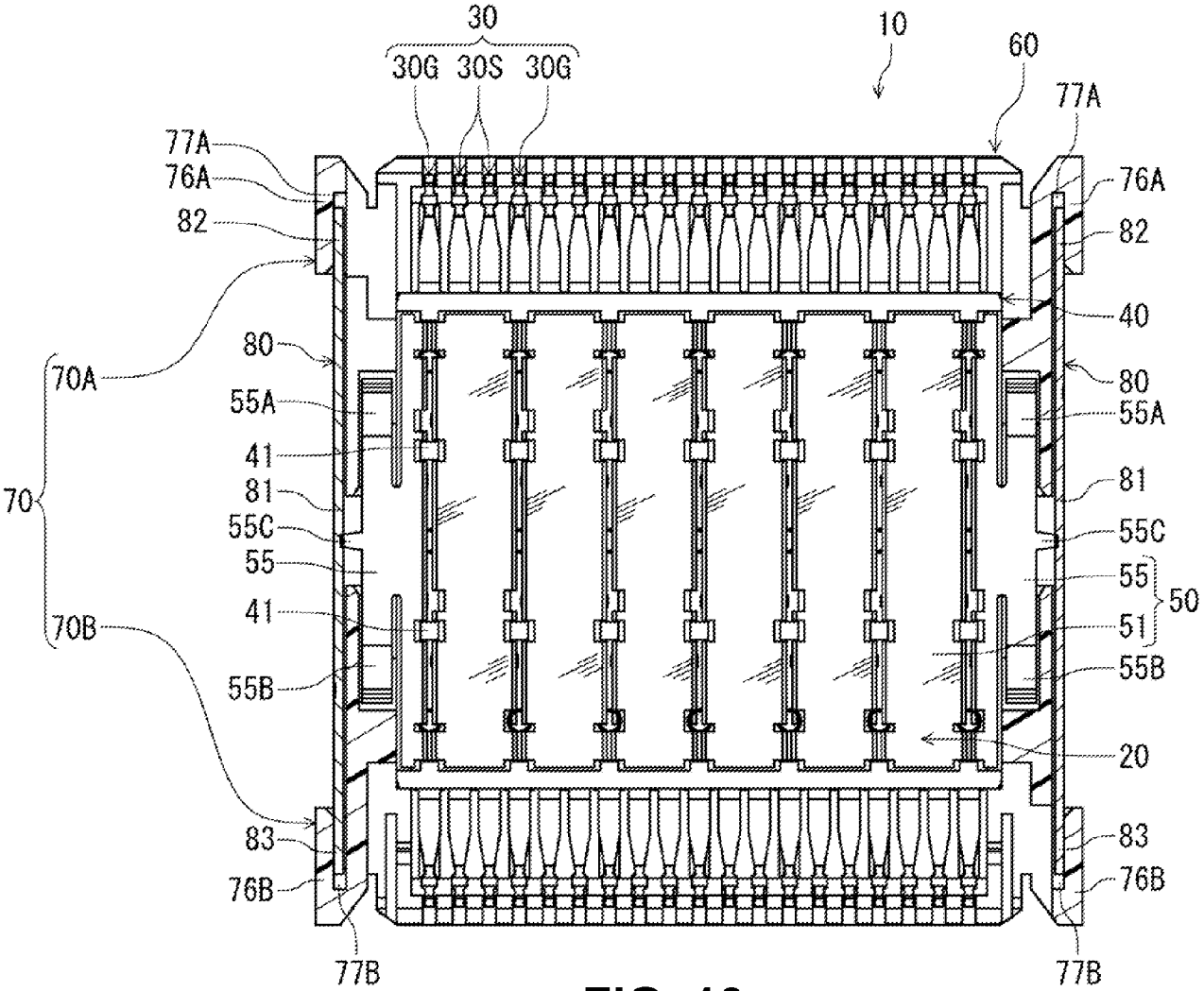
FIG. 10 is a sectional view showing the intermediate electrical connector taken at a surface perpendicular to an arrangement direction of the intermediate electrical connectors, more specifically which is taken at a plate surface of the inner ground plate, according to the embodiment of the present invention.

As shown in FIG. 9(B), the upper supporting members 82 are strip-like sections extending upward from an upper edges of the strip-like sections 81A. The upper supporting members 82 have smaller dimension in the arrangement direction than the strip-like sections 81A and the upper holes to be supported 77A of the intermediate connecting members 10.

Figure 11:
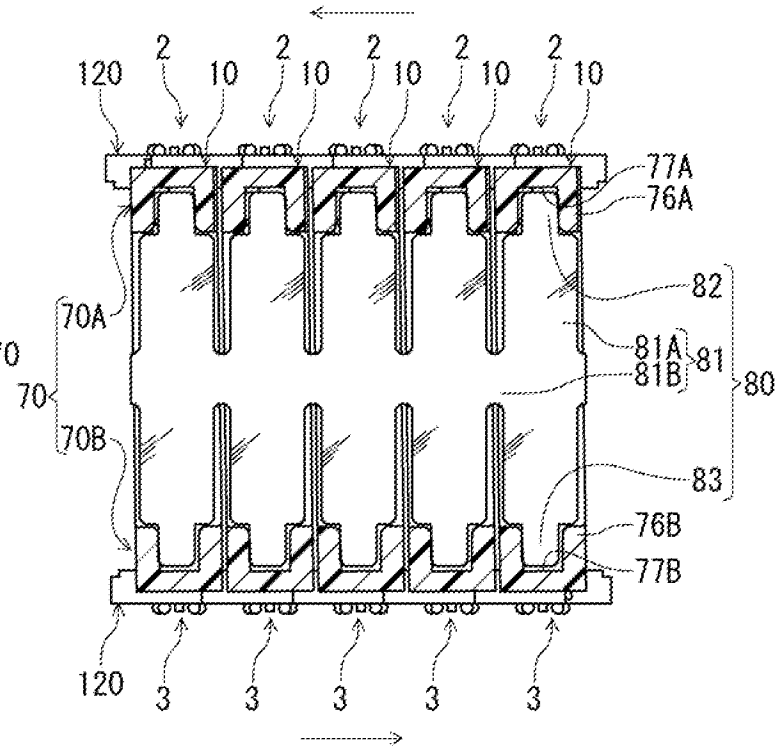
Figure 11:
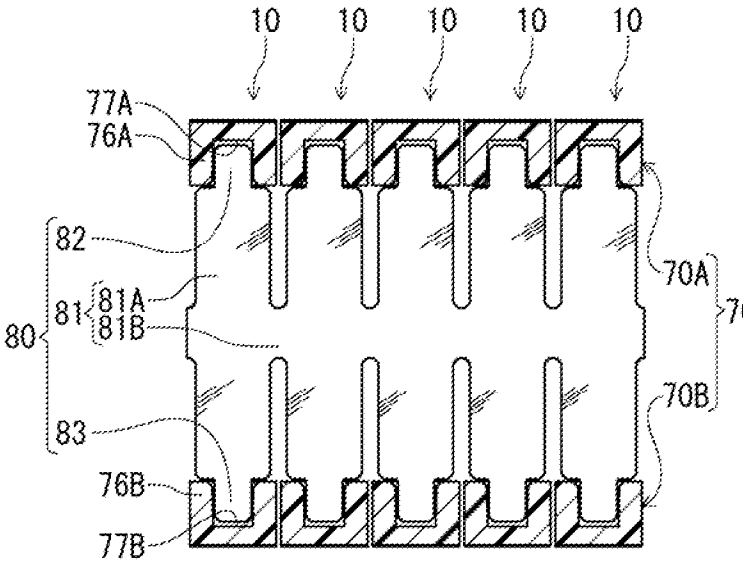

Therefore, when the upper supporting members 82 are housed in the upper holes to be supported 77A of the upper holding body 70A, as shown in FIG. 11(A), there are formed gaps between facing inner wall surfaces (inner surfaces perpendicular to the arrangement direction) of the upper holes to be supported 77A in the arrangement direction and side edges of the upper supporting members 82. As will be described later, those gaps allow the intermediate connecting members 10 to make tilting motions.

The lower supporting members 83 have the same configurations as the upper supporting members 82, and have the same shapes of the upper supporting members 82 but turned upside down. The explanation of the lower supporting members 83 will be omitted by affixing reference numeral that "1" is added to reference numerals of corresponding parts of the upper supporting members 82.

As shown in FIG. 10, according to the embodiment, tips of the pressure-welding protruding portions 55C and 65C of the grounding plates 50 and 60 protrude outward from outer surfaces of the short walls 72A and 72B of each blade holding member 70 in the connector's widthwise direction, and contact by pressure to inner surfaces of the support members 80 towards outside in the connector's widthwise direction. Therefore, the upper and lower supporting members 82 and 83 of the support members 80 energize the outer inner wall surfaces (surfaces that contact by pressure with outer sheet surfaces of the upper and the lower supporting members 82 and 83) of the support holes 76A and 76B towards outside in the connector's widthwise direction.

As a result, there is no backlash in the connector's widthwise direction between the respective holding bodies 70 and the support members 80, and the blade holding member 70 is securely kept at a normal position in the connector's widthwise direction. Therefore, it is easier to connect the relay connector 1 to the mating connecting bodies 2 and 3. In addition, by pressure welding the pressure-welding protruding portions 55C and 65C to inner surfaces of the support members 80, the support members 80, which are metal members, and the grounding plates 50 and 60 are electrically connected to each other. Therefore, it is possible to improve the grounding effect.

According to the embodiment, the support member 80 includes sections (referred to as "vertically long flat section), each of which is composed of the strip-like section 81A, the upper supporting member 81A, and the lower supporting member 83. The vertically long sections are connected with relay sections 81B so as to have a repetitive configuration in the arrangement direction of the intermediate connecting members 10 as a whole.

Therefore, it is possible to suitably obtain the support member 80 by preparing a sheet metal piece, in which a number of the vertically long flat sections are connected with the relay sections 81B, and then cutting the sheet metal piece in a suitable length for the number of the intermediate connecting members 10 (a dimension in the arrangement direction). As a result, even when the number of the intermediate connecting members 10 and the space between the intermediate connecting members 10 increase or decrease upon designing, it is still possible to make a desired length of the support members 80 from one type of sheet metal piece by cutting the sheet metal piece according to the number of or space between the intermediate connecting members 10.

Therefore, it is possible to restrain the manufacturing cost. Here, according to the embodiment, the support members 80 are made from the sheet metal piece, but a material of the support members 80 is not limited to this. For example, it is possible to make the support members 80 from resin.

The relay connector 1 of the embodiment may be produced as described below. First, the step of making the blades 20 will be described. Dividing a plurality of terminals 30 to be provided in one blade 20 into two groups, there are provided two types of terminal groups (illustrated in FIGS. 8(A) and 8(B), respectively). Putting the two types of terminal groups together, a row of the terminals 30 to be provided in one blade 20 is formed as shown in FIG. 8(C).

Then, placing the row of the terminals 30 in a mold (not illustrated) for molding the substrate 40, molten resin is poured into the mold and solidified so as to integrally mold the row of the terminals 30 and the substrate 40. After that, of the two sheet surfaces of the substrate 40, an inner surface (sheet surface provided on a side of contact surfaces of the contact sections 31 and 32 of the terminals 30) is attached to the inner grounding plate 50. The outer surface (sheet surface provided on a side opposite the contact surfaces of the contact sections 31 and 32 of the terminals 30) of the substrate 40 is attached to the outer grounding plate 60.

As described above, those surfaces of the substrate 40 are attached to the inner grounding surface 50 and the outer grounding surface 60 by ultrasonic welding and thereby the blade 20 is completed (FIG. 5).

Next, assembling of the relay connector 1 will be described. First, as shown in FIG. 9(A), a plurality of lower support members 70B is arranged in the arrangement direction of the intermediate connecting members 10. As shown in FIG. 9(B), the lower supporting members 83 of the supporting members 70B axe inserted in the lower holes to be supported 77B, which are provided on the both side surfaces of the respective lower holding bodies 70B, from thereabove.

Thereafter, as shown in FIG. 9(C), the inner surfaces of the two blades 20, which are respectively held by the lower holding bodies 70B, are placed so as to face each other. Then, lower parts of the respective blades 20 are housed in the blade housing holes 74B of the lower holding bodies 70B from thereabove.

At this point, into the lower attachment holes 75B of the longer walls 71B and the lower attachment holes (not illustrated) of the dividing wall 73B of each lower holding body 70B, the lower attachment sections 65B of the outer grounding plate 60 and the lower attachment sections 55B of the inner grounding plate 50 of each blade 20 are housed and locked in the lower attachment holes. As a result, it is possible to prevent the blades 20 from coming off upward from the lower holding bodies 70B.

Then, as shown in FIG. 9(D), while being turned upside down relative to the lower holding bodies 70B, the upper holding bodies 70A are mounted on the respective corresponding blades 20 from thereabove. This assembling procedure is similar to the one for mounting the blades 20 on the lower holding bodies 70B. Accordingly, assembling of the relay connector 1 is completed.

Next, configurations of the mating connectors 2 and 3 will be described. As shown in FIG. 1, according to the embodiment, the intermediate connecting members 10 and the mating connectors 2 and 3, each of which is provided in the same number as that of the intermediate connecting members 10, are arranged at constant intervals in the same direction as the arrangement direction of the intermediate connecting members 10. All the mating connectors 2 and 3 are connected with connecting members 120, which will be described later. The mating connectors 2 and 3 have the same configuration. Therefore, the configuration of the mating connectors 3 will be mainly described. The explanation of the mating connectors 2 will be omitted affixing the same reference numerals as those of the mating connectors 3.

Figure 12:
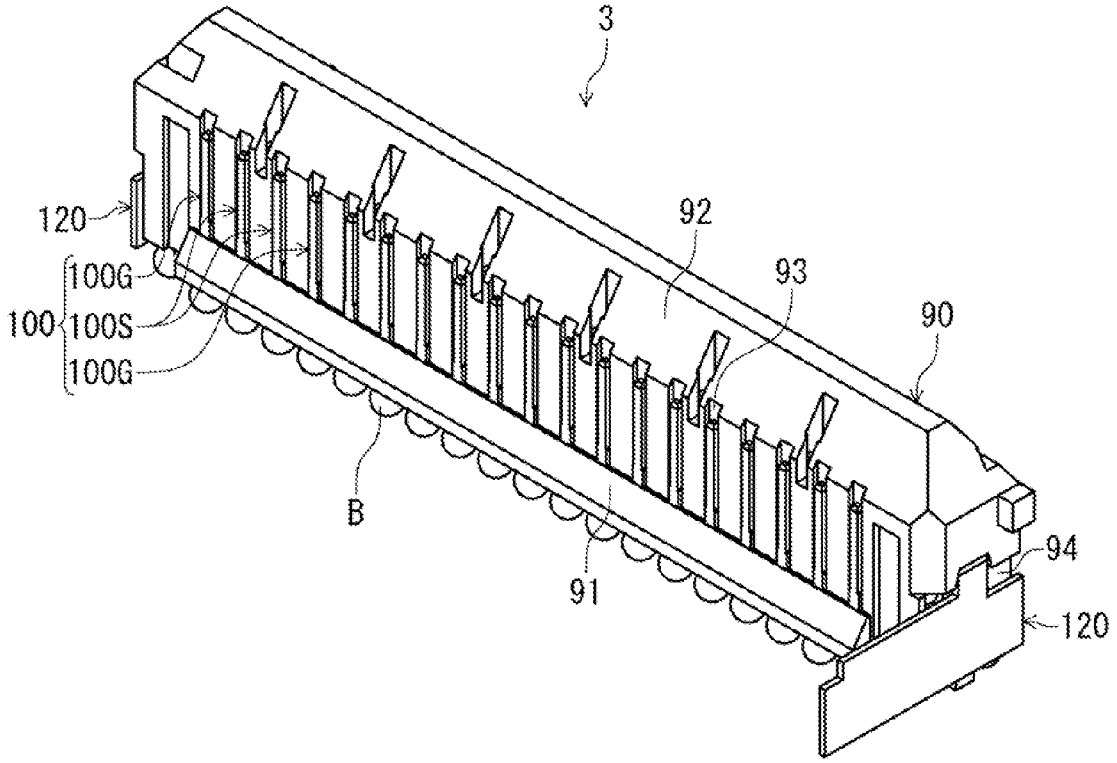
FIG. 12 is a perspective view showing one of the mating connectors.
Figure 13:
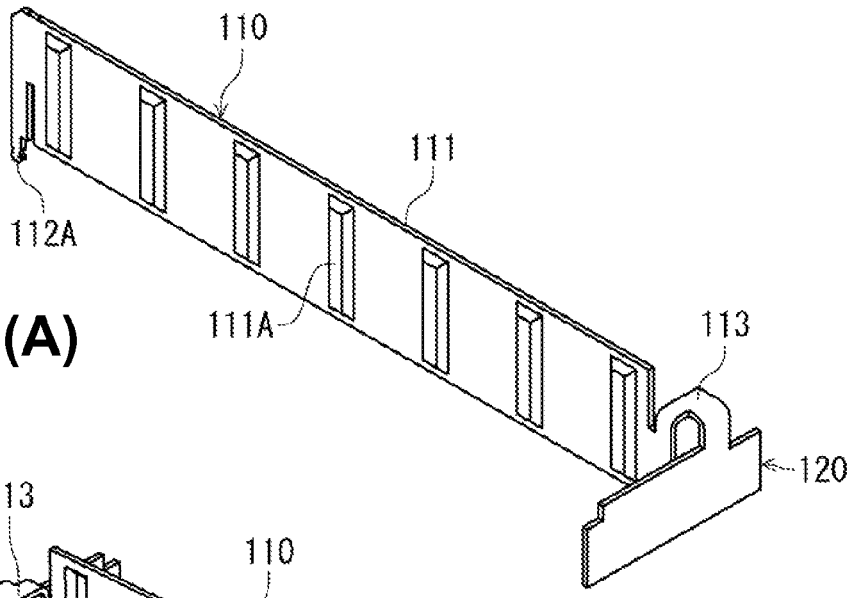
Figure 13:
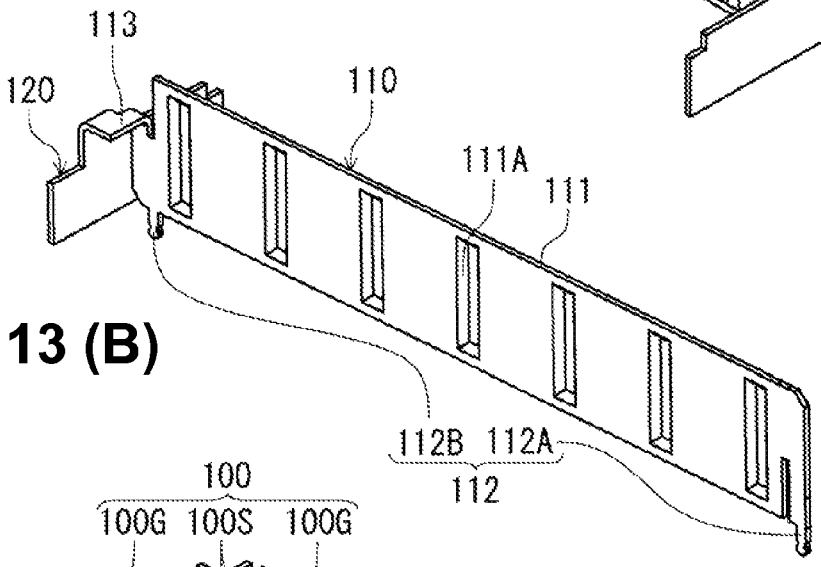
Figure 13:
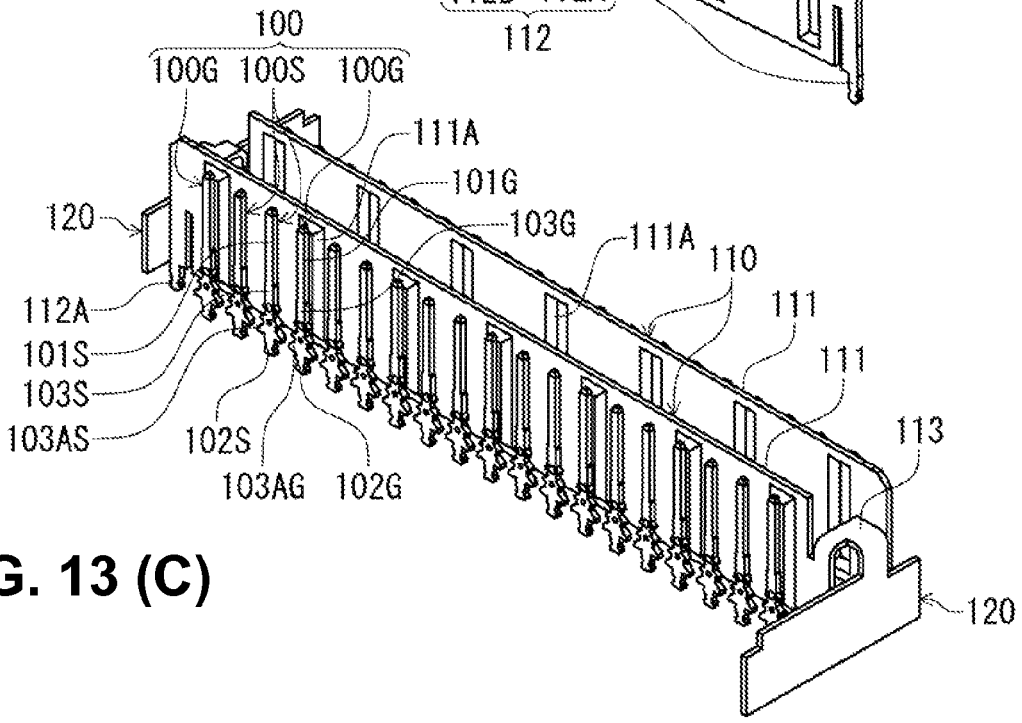

As shown in FIG. 12, each mating connector 3 includes a housing 90, a plurality of terminals 100 (hereinafter referred to as "mating terminals 100"), and two mating grounding plates 110. The housing 90 is made of an electrically insulating material and extends having the connector's widthwise direction as its longitudinal direction. The mating terminals 100 are arranged and held by the housing 90 in the connector's widthwise direction. The housing 90 also holds the two mating grounding plates 110 (See FIGS. 13 through 16).

As shown in FIG. 1, the housing 90 extends having the connector's widthwise direction as its longitudinal direction. The housing 90 has generally the same dimension as that of the relay connector 1 in the connector's widthwise direction. As shown in FIG. 12, the housing 90 includes a basal section 91 that forms a lower part of the housing 90, and fitting wall sections 92 that rises upward from the basal section 91. The fitting wall sections 92 are formed as fitting sections to be fitted in the lower receiving sections 12 of the intermediate connecting members 10.

Furthermore, each housing 90 includes a plurality of terminal housing sections 93 that extend in the up-and-down direction. The plurality of terminal housing sections 93 is arranged at constant intervals in the connector's widthwise direction and holds the mating terminals 100 therein. The terminal holding sections 93 are formed as groove portions on both wall surfaces (surfaces perpendicular to the arrangement direction of the mating connectors 3) of the fitting wall sections 92, which extend in the connector's widthwise direction in the range where the fitting wall sections 92 are present in the up-and-down direction.

The terminal housing sections 93 are formed as through holes, which connect to the groove portions and penetrate the basal section 91 in the range where the basal section 91 is present in the up-and-down direction.

In addition, the terminal housing sections 93 to house the mating grounding terminals 100G have openings (FIGS. 14(A) and 14(B)) opened on their grove bottoms towards a mating side in the arrangement direction. From the openings, mating contact sections 101G and mating joining sections 103G of the mating grounding terminals 100G, which will be described later, are exposed. As a result, as will be described later, the grounding contact sections 111A of each mating grounding plate 110 can contact with mating contact sections 101G and mating joining sections 103G of the mating grounding terminals 100G (See FIG. 14(B)).

As shown in FIG. 12, on both side surfaces (surfaces perpendicular to the connector's widthwise direction) of each housing 90, there are formed recessed sections 94, which are formed being recessed only on lower parts of the sides of each housing 90. Those recessed sections 94 are recessed in the amount of a thickness of the connecting member 120, which will be described later, and are formed so as to place the connecting members 120 in the recessed sections 94.

As shown in FIG. 13(C), the mating terminals 100 are made by punching a sheet metal piece in the thickness direction thereof and have strip-like shapes extending in the up-and-down direction as a whole. As shown in FIG. 12, the mating terminals 100 are pressed in the terminal housing sections 93 of each housing 90 from thereunder, and arranged in the connector's widthwise direction. The plurality of mating terminals 100 is used as signal terminals 100S (hereunder referred to as "mating signal terminals 100S") or grounding terminals 100G (hereunder referred to as "mating grounding terminals 100G").

According to the embodiment, the mating terminals 100 are arranged so as to correspond the arrangement of the signal terminals SOS and the grounding terminals 30G, which are provided on the blades 20 of each intermediate connecting member 10.

More specifically, as shown in FIGS. 13(C) and 14(A), the mating terminals 100 are arranged such that the two adjacent mating signal terminals 100S are placed between the mating grounding terminals 100G. Hereunder, when it is not necessary to specially distinguish between the mating signal terminals 100S and the mating grounding terminals 100G, they are simply referred to as "mating terminals 100" for description of the configuration.

Here, FIG. 14(A) is a sectional view of the mating connector 3, taken at a position of the joining section 103 in the mating terminals 100 in the up-and-down direction when viewed from thereunder.

As well shown in FIG. 14(A), the mating terminals 100 are provided on both sheet, surfaces of the fitting wall sections 92 of the housing 90, and are provided in two rows that is symmetrical about the fitting wall sections 92 in the wall's thickness direction of the fitting wall sections 92 (the arrangement direction of the mating connectors 3). As shown in FIGS. 14(B) and 14(C), each mating terminal 100 includes a mating contact section 101 formed on an upper end side thereof, a mating connecting section 102 formed on a lower end side thereof, and a mating joining section 103 that joins the mating contact section 101 and the mating connecting section 102.

As shown in FIG. 13(C), each mating joining section 103 includes press-in protruding portions 103A for pressing in the terminal housing section 93. The press-in protruding portions 103A are formed protruding from the both side edges of the mating joining section 103.

Each mating contact section 101 contacts with the lower contact section 32A of the terminal 30 of the relay connector 1 (See FIGS. 16(A) and 16(B)). More specifically, the mating contact sections 101S of the mating signal terminals 100S contact with the lower contact sections 32AS of the signal terminals 30S. The mating contact sections 101G of the mating grounding terminals 100G contact with the lower contact sections 32AG of the grounding terminals 30G.

In addition, as shown in FIGS. 14(B) and 14(C), the connecting sections 102 protrude from a bottom surface of the basal section 91 of each housing 90, and have solder balls B respectively attached thereto. The connecting sections 102 are formed so as to be connected to corresponding circuit unit (not illustrated) of a circuit board by soldering. More specifically, the connecting sections 102S of the mating signal terminals 100S are connected to a signal circuit unit. The connecting sections 102G of the mating grounding terminals 100G are connected to a grounding circuit unit.

Each mating grounding plate 110 is made from a sheet, metal piece by press work and bending work. As shown in FIGS. 13(A) through 13(C), each mating grounding plate 110 includes a mating grounding main body 111 and grounding legs 112. The mating grounding main body 111 has sheet surfaces perpendicular to the arrangement direction of the mating connectors 3, and extends over generally the whole area where the mating connector 3 is present in the connector's width direction.

The grounding legs 112 extend downward from both ends of a lower edge of the mating grounding main body 111 in the connector's widthwise direction. In addition, the mating grounding plate 110 also includes a joining section 113. The joining section 113 connects the mating grounding main body 111 and the connecting member 120, which will be described later.

As shown in FIG. 14(A), the mating grounding main body 111 extends in a middle of the fitting wall section 92 of the housing 90 in the range of wall's thickness thereof, that is, extends in the connector's widthwise direction between the rows of mating terminals 100. In other words, the mating grounding main body 111 is provided on a side opposite the contact surfaces of the mating contact sections 101, which is one of two sheet surfaces of the mating terminals 100.

In addition, as shown in FIGS. 14(B) and 14(C), the mating grounding main body 111 is provided corresponding to the range where the mating contact sections 101 and the mating joining sections 103 of the mating terminals 100 are present in the up-and-down direction.

As shown in FIGS. 14(A) and 14(B), each mating grounding main body 111 includes grounding contact protruding portions 111A, which protrude towards the mating grounding terminals 100G and extend in the up-and-down direction at the same positions as those of the mating grounding terminals 100G in the arrangement direction of the mating terminals 100. The grounding contact protruding portions 111A are formed by press work (See also FIGS. 13(A) through 13(C)). As shown in FIGS. 14(A) and 14(B), the grounding contact protruding portions 111A contact with sheet surfaces of the mating contact sections 101G and the mating joining sections 103G of the mating grounding terminals 100G at their protruding ends.

As described above, according to the embodiment, the grounding contact sections 111A contact with sheet surfaces of the mating contact sections 101G and the mating joining sections 103G. Therefore, as shown in FIG. 14(A), the mating contact sections 101G and the mating joining sections 103G of each pair composed of two adjacent signal terminals 30S are shielded from outside on a side of a sheet surface that faces the mating grounding plate 110 in the up-and-down direction (FIG. 14(A) only shows shielding of the mating joining section 103G).

As already described, in the intermediate connecting members 10 of the relay connector 1, the elastic arms 32S of the two signal terminals 30S are shielded from outside on a side of sheet surface that faces the outer grounding plate 60 (See FIG. 16(B)). Therefore, according to the embodiment, in a state that the connectors are fitted, the contacting parts of the contact sections 32AS and the mating contact sections 101S in the respective pairs are surrounded by the outer grounding plate 60, two grounding terminals 30G, the mating grounding plate 110, and two mating grounding terminals 100G, and shielded from outside.

As a result, in the contacting parts, it is possible to securely prevent cross talks between the pairs. It is also possible to securely transmit signals without influence of noises from outside. The contact parts between the signal terminals 30S are shielded similarly also in a state that the relay connector 1 and the mating connectors 2 are fitted.

As shown in FIGS. 13(C) and 14(A), according to the embodiment, two mating grounding plates 110 are provided being symmetrical such that the grounding contact protruding portions 111A protrude towards the opposite side in the arrangement direction (wall's thickness direction of the fitting wall sections 92). As well shown in FIG. 14(A), the two mating grounding plates 110 are held by integral molding with the housing 90.

Each first grounding legs 112A is provided at one end of the mating grounding main body 111 in the connector's widthwise direction (on a side where the connecting member 120 is not connected thereto). As shown in FIGS. 13(A) through 13(C), each first grounding leg 112A is formed as a strip-like section outside the range where the mating terminals 100 are arranged.

Each first grounding leg 112A extends downward from generally a center of the mating grounding main body 111 in the up-and-down direction. Moreover, a second grounding leg 112B is provided at the other end of the mating grounding main body 111 (on a side that the connecting member 120 is joined thereto).

As shown in FIG. 13(B), each second grounding leg 112B is formed as a strip-like section, which extends downward from the same position as the lower edge of the mating grounding main body 111 in the up-and-down direction, outside the range of where the mating terminals 100 are arranged. As shown in FIG. 13(C), the first and the second grounding legs 112A and 112B have their ends slightly above the connecting sections 102 of the mating terminals 100, and are to be connected by soldering to corresponding grounding circuit unit (not illustrated) of a circuit board.

At the other end of each mating grounding main body 111, there is formed joining section 113 that joins the connecting member 120 to the mating grounding main body 111.

As shown in FIGS. 13(A) and 13(B), each joining section 113 is bent at a right angle at an upper edge of the other end of the mating grounding main body 111 (a portion closer to the other end than the grounding leg 112B) and bent at a right angle downward at an outer edge thereof. The joining section 113 is joined to an upper edge of the connecting member 120.

FIGS. 15(A) through 15(D) are perspective views showing the steps of making the plurality of mating grounding plates 110 connected to carriers. First, as shown in FIG. 15(A), metal workplaces are prepared, in which both ends of a plurality of grounding plates are respectively joined to carriers C (which will be used as connecting sections 120 later).

Each metal workpiece has sheet surfaces such that the mating grounding plates 110 and the carriers C are horizontal to each other, and looks like a plate member as a whole. Then, as shown in FIG. 15(B), one of the carriers C on a side of one ends of the grounding plates 110 is removed by cutting. Boundary parts between the joining sections 113 and the grounding main body sections 111 are bent at a right angle so as to have the respective mating grounding main bodies 111 rise.

Figure 14:
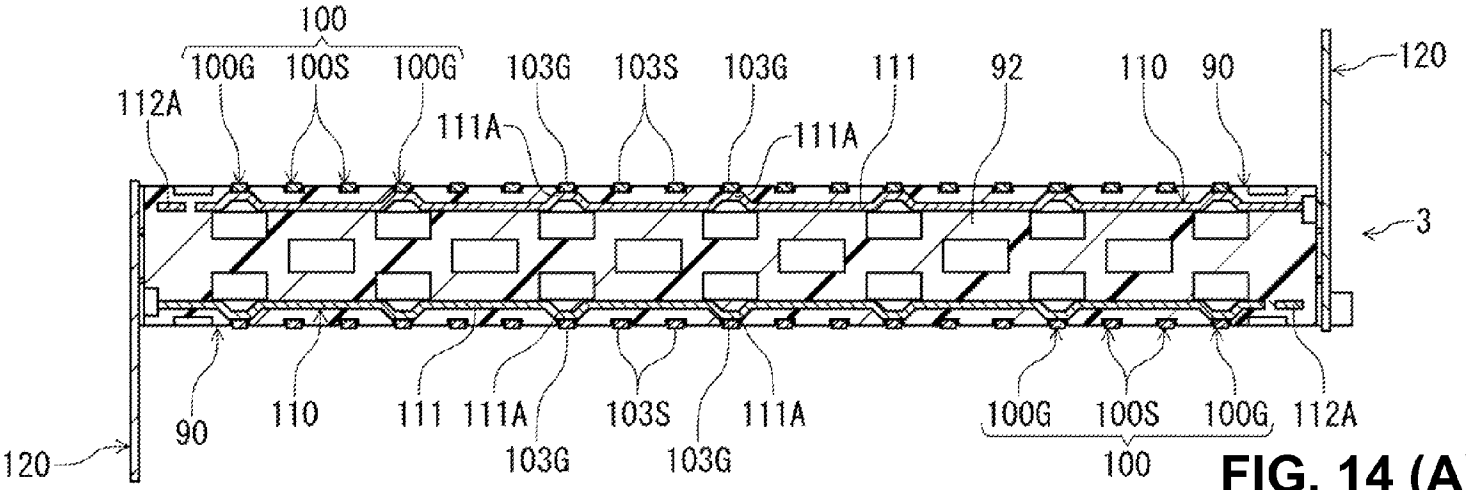
Figure 14:
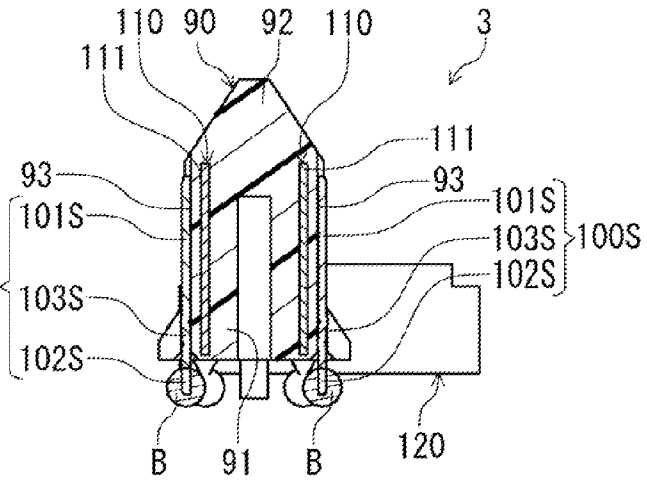
Figure 14:
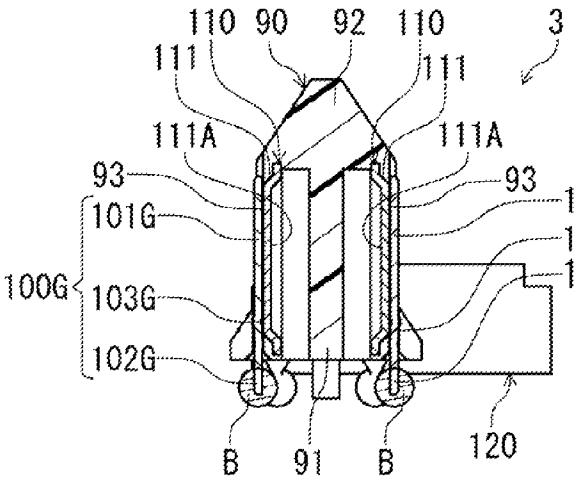
Figure 15:
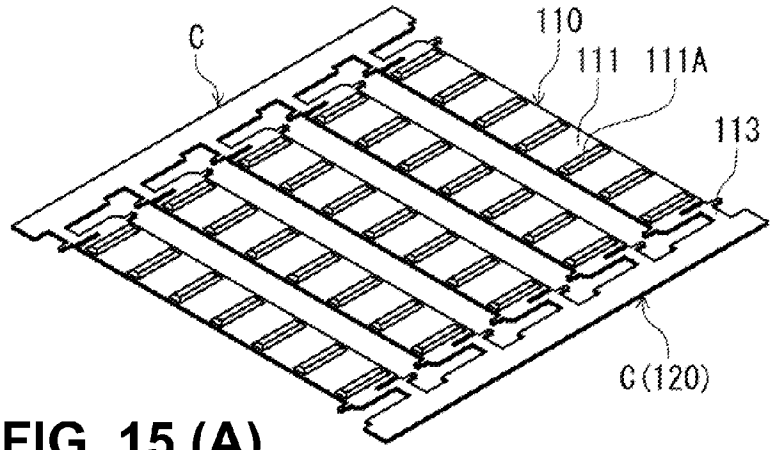
FIGS. 15(A) through 15(D) are perspective views showing the steps of fabricating a plurality of mating ground plates.
Figure 15:
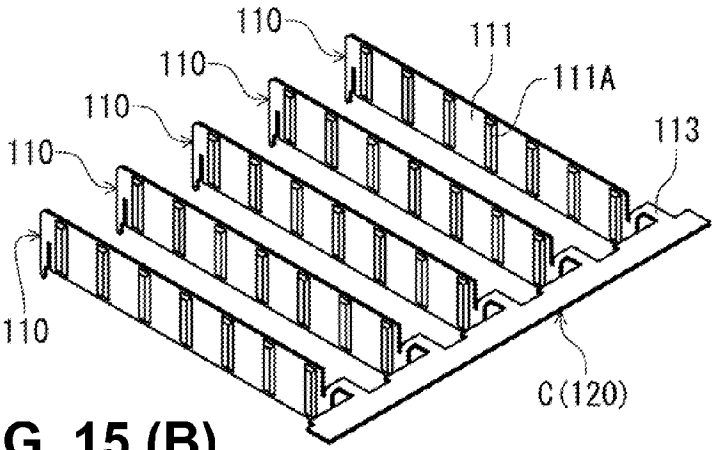
Figure 15:
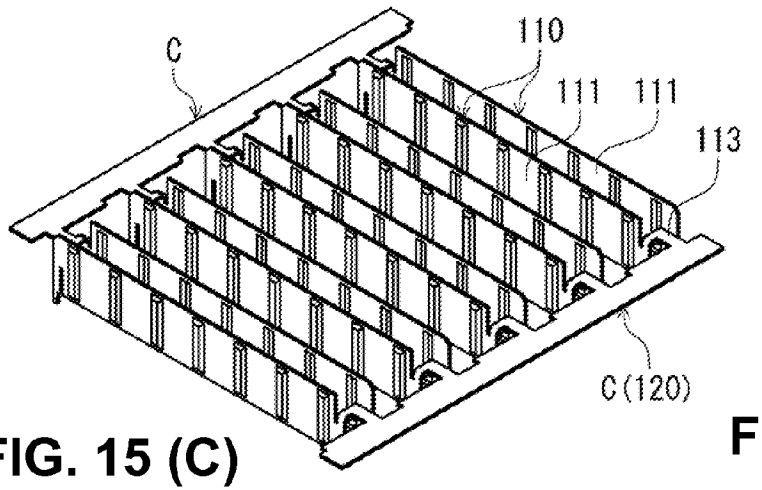
Figure 15:
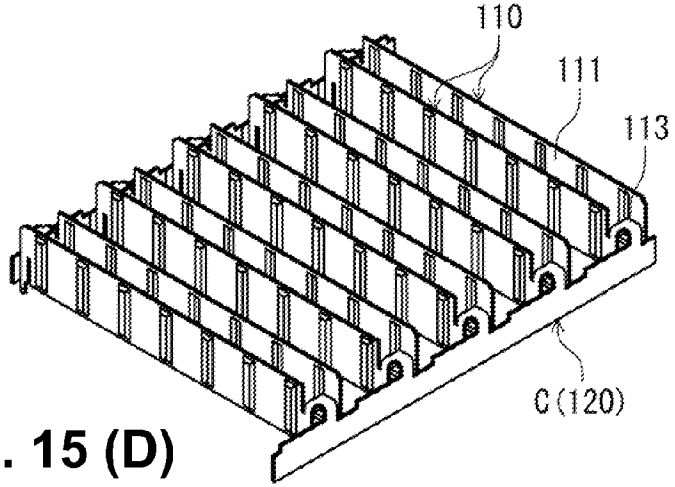

Thereafter, as shown in FIG. 15(C), two metal workplaces of FIG. 15(B) are put together, such that the mating grounding plates 110 of the respective metal workpieces are alternately arranged in the arrangement direction of the mating connectors 3 (a longitudinal direction of the carrier C). At this point, the mating grounding plates 110 of each pair symmetrically face each other in the arrangement direction of the mating connectors 3. Then, as shown in FIG. 14(D), the carriers C of the two metal workpieces are bent downward at right angle at a boundary between the joining sections 113 and the carriers C. As a result, the sheet surfaces of the carriers C are perpendicular to the connector's widthwise direction and the carriers C can be used as the connecting members 120. Thereafter, the respective two mating grounding plates 110 in FIG. 14 are integrally molded with the housing 90, keeping the attitude.

As described above, according to the embodiment, the connecting members 120 are originally the carriers C connected to the plurality of mating grounding plates 110. Even after the integral molding of the mating grounding plates 1110 with the housing 90, each carrier C will not be separated from the mating grounding plates 110.

As shown in FIG. 1, each connecting member 120 connects and supports the plurality of mating connectors 3 via the mating grounding plates 110 respectively supported by the respective housing 90. The connecting members 120 are bent at a right angle so as to have their sheet surfaces perpendicular to the connector's widthwise direction. The joining sections 113 are disposed in the recess sections 94 of the housings 90 of the respective mating connectors 3.

As described above, the plurality of the mating connectors 3 are joined with the connecting members 120. Therefore, it is easier to maintain precision of physical relationship among the mating connectors 3, so that it is possible to securely connect the relay connector 1 to the mating connectors 3.

Moreover, each carrier C generally has a large width and great strength, so that it is suitable as the connecting member 120. In addition, it is possible to keep the carrier C without cutting away from the grounding plates 110 and discarding and to effectively use as the connecting member 120. Therefore, it is possible to restrain the manufacturing cost.

Furthermore, since the respective grounding plates are electrically connected by the connecting members 120, it is also possible to improve the grounding effect. Moreover, the connecting members 120 cover the side end surfaces of the mating connectors 3 by their sheet surfaces, so that it is also possible to use the connecting members 120 as shielding plates.

Referring now to FIGS. 1 and 2, procedure for fitting the relay connector 1 to the mating connectors 2 and 3 will be described. First, a plurality (five each in the embodiment) of the mating connectors 2 and 3 is attached to different circuit boards (not illustrated) by soldering. Thereafter, the mating connectors 3 are positioned so as to have the fitting wall sections 92 rise upward (as shown in FIG. 1). The lower receiving sections 12 of the respective intermediate connecting members 10 of the relay connector 1 are positioned so as to correspond to the fitting wall sections 92 of the mating connectors 3, and the relay connector 1 is placed above the mating connectors 3.

Then, moving the relay connector 1 downward, the respective intermediate connecting members 10 are fitted to the corresponding mating connectors 3 from thereabove. At this time, the fitting wall sections 92 of the mating connectors 3 enter the lower receiving sections 12 of the intermediate connecting members 10. Once the fitting between the relay connector 1 and the mating connectors 3 is completed, the lower contact sections 32A of the terminals 30 provided on the blades 20 of the intermediate connecting members 10 contact with certain contact pressure to the mating contact sections 101 of the mating terminals provided in the mating connectors 3.

Figure 16:
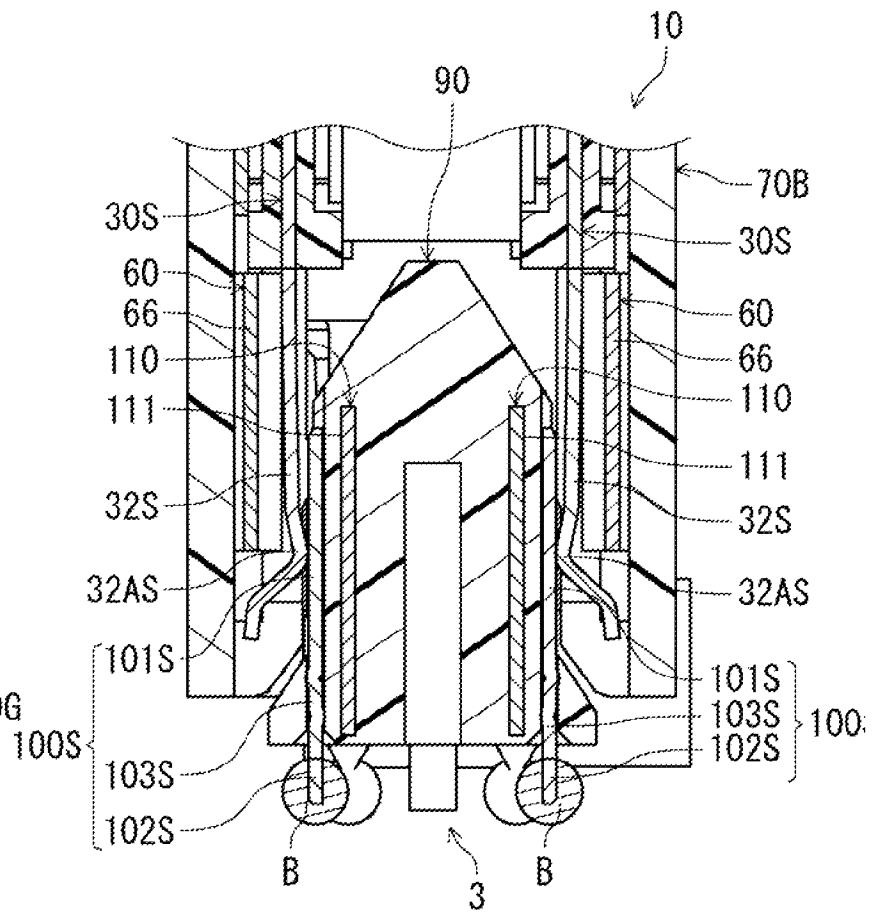
FIGS. 16(A) and 16(B) are enlarged sectional views showing a fitting part of the intermediate electrical connector and the mating connector in their state of fitting to each other.
Figure 16:
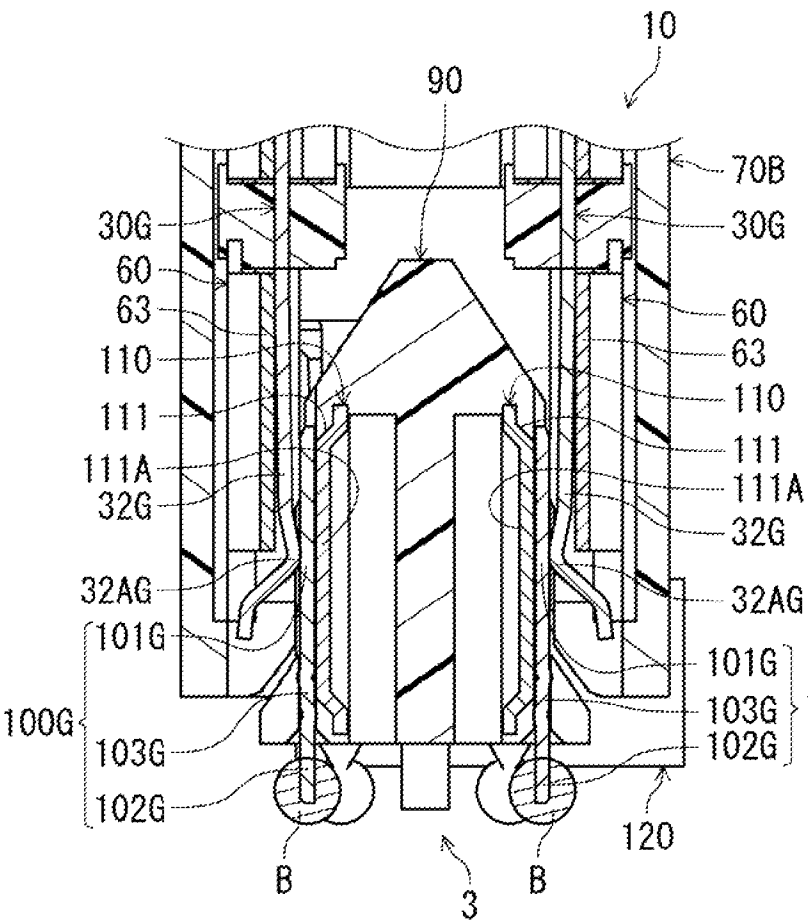

More specifically, as shown in. FIG. 16 (A), the lower contact sections 21AS of the signal terminals 30S contact with the mating contact sections 101S of the mating signal terminals 100S. As shown in FIG. 16(B), the lower contact sections 32GS of the grounding terminals 30G contact with mating contact sections 101G of the mating grounding terminals 100G.

Thereafter, the mating connectors 2 are positioned so as to be turned upside down relative to the mating connectors 3. Then, the mating connectors 2 are fitted and connected to the relay connector 1 from thereabove. Since the procedure for fitting and connecting the mating connectors 2 is the same as the above-described procedure for fitting and connecting the mating connectors 3 to the relay connector 1, so that the explanation is omitted. As shown in FIG. 2, the mating connectors 2 and the mating connectors 3 are fitted and connected to the relay connector 1, and thereby the mating connectors 2 and the mating connectors 3, which correspond to each other, are electrically connected via the respective intermediate connecting members 10.

According to the embodiment, in the inner grounding plates 50 and the outer grounding plates 60 provided in the blades 20 of the relay connector 1, the outer grounding plates 60 shield the range that corresponds to where the contact sections 31A and 32A of the terminals 30 are present from a side opposite the contact surfaces of the contact sections 31A and 32A.

In addition, for the mating connectors 2 and 3, the mating grounding terminals 110 shield the range that corresponds to where the mating contact sections 101 of the mating terminals 100 are present from a side opposite the contact surfaces of the mating contact sections 101.

Therefore, according to the embodiment, in a state that the connectors are connected, the parts where the contact sections 31A and 32A and the mating contact sections 101 contact are shielded by the outer grounding plates 60 and the mating grounding plates 110 from both sides of the blades 20 in the sheet thickness direction (the shielding of the part where the relay connector 1 and the mating connectors 3 connect to each other is shown in FIGS. 16(A) and 16(B)). As a result, it is possible to securely transmit signals at the contacting parts without influence of noises from outside.

In addition, according to the embodiment, the outer grounding plates 60 and the grounding terminals 30G are provided as separate members. The grounding plates 60 contact with the joining sections 33G of the grounding terminals 30G. In other words, it is not necessary to form the outer grounding plates 60 to include grounding contact sections having flexibility like conventional ones.

Therefore, upon designing the outer grounding plates 60, there is no restriction on the shapes of parts that correspond to the contact sections 31AS and 32AS of the signal terminals 30S, so that it is possible to freely design the shapes of the parts. As a result, it is possible to easily adjust impedance by designing the shapes of the parts that correspond to the contact sections 31AS and 32AS so as to be able to obtain satisfactory matching of impedance at the parts where the signal terminals 30S and the mating signal terminals 100S contact (e.g., the above-described shapes of the protruding pad-like sections 66.

Next, referring to FIG. 11(B), floating operation will be described, when there is displacement between the mating connectors 2 and 3 in the arrangement direction of the intermediate connecting members 10 (a left-and-right direction in FIG. 11(B)).

In the embodiment, a case is described when displacement occurs among the mating connectors 2 and 3 by external force unexpectedly applied on the mating connectors 2 and 3. Here, the external force is applied on the mating connectors 2 and 3 in opposite directions to each other in the arrangement direction in a state that the connectors are fitted. In the example of FIG. 11(B), the displacement is supposed to occur by relative rightward movement of the mating connectors 3 and relative leftward movement of the mating connectors 2 (See the respective arrows in FIG. 11(B)).

Once the displacement among the mating connectors 2 and 3 occurs in the arrangement direction, within the range of the spaces between the inner wall surfaces of the holes to be supported 77A and 77B of the intermediate connecting members 10 and the supporting members 82 and 83 of the support members 80, the intermediate connecting members 10 tilt according to the displacements. At this time, the intermediate connecting members 10 tilt while keeping the state that the supporting members 82 and 83 stably support the holes to be supported 77A and 77B.

According to the embodiment, the intermediate connecting members 10 are not supported by being housed in the slit-like housing groove portions formed in housing as in a conventional relay connector, but are supported by the flat support members 80 provided on the both side surfaces of the intermediate connecting members 10. Therefore, it is not necessary to provide a dividing wall in the housing between the intermediate connecting members as in a conventional relay connector, so that it is possible to provide the relay connector bodies 10 close to each other.

In addition, it is also possible to reduce the size of the relay connector 1 in the arrangement direction. Moreover, it is also not necessary to provide an end wall on the housing outside of the arrangement range of the intermediate connecting members 10, so that it is possible to further reduce the size of the relay connector 1 in the arrangement direction.

Furthermore, according to the embodiment, since the support members 80 are flat members, it is not necessary to provide housing groove portions or receiving groove portions, which do not have so large width, in a large number and close to each other. In addition, it is not necessary to form the protruding portions in the receiving groove portions. Accordingly, the support members 80 don't have to have complicated shapes. Therefore, it is easily produce the support members 80.

According to the embodiment, there are two blades 20 provided in each intermediate connecting member 10. However, the number of the blades 20 is not limited to this. For example, it is possible to provide one blade 20 in each intermediate connecting member 10. In this case, correspondingly, the mating connectors 2 and 3 only have the mating terminals 100 and the mating grounding plates 110, which correspond to the one blade 20.

According to the embodiment, the two mating connecting bodies are mating connectors. Alternatively, one of the mating connecting bodies can be a circuit board. In this case, the terminals of the intermediate connecting member include connecting sections at ends thereof to be connected to the circuit board. The connecting sections are connected to the circuit board by soldering.

According to the embodiment, the intermediate electrical connector includes a plurality of the intermediate connecting members. Alternatively, the intermediate electrical connector may be composed of one intermediate connecting member. In this case, it is not necessary to provide the support member to support the intermediate connecting member.

The disclosure of Japanese Patent Applications No. 2013-192123, filed on Sep. 17, 2013, is incorporated in the application by reference.

While the present invention has been explained with reference to the specific embodiments of the present invention, the explanation is illustrative and the present invention is limited only by the appended claims.

What is claimed is:

1. An intermediate electrical connector to be connected to a mating connecting member, comprising:

an intermediate connecting member; and a blade disposed in the intermediate connecting member, wherein said blade includes a first ground plate, a second ground plate, a base member, a signal terminal, and a ground terminal, said signal terminal and said ground terminal are disposed on a common surface of the base member and between the first ground plate and the second ground plate, said signal terminal includes a first upper contact portion, a first lower contact portion, and a first connecting portion connected to the first upper contact portion and the first lower contact portion, said ground terminal includes a second upper contact portion, a second lower contact portion, and a second connecting portion connected to the second upper contact portion and the second lower contact portion, said first ground plate is situated on one side of the blade over the first connecting portion and the second connecting portion, said first ground plate is arranged to contact with the second connecting portion, said second ground plate is situated on an opposite side of the blade over the first connecting portion, the second connecting portion, the first upper contact portion, the first lower contact portion, the second upper contact portion, and the second lower contact portion, and said second ground plate is arranged to contact with the second connecting portion.

2. The intermediate electrical connector according to claim 1, wherein said second ground plate includes a protruding portion over the first contact portion, and said protruding portion is away from the first contact portion by a distance determined according to an impedance at the first contact portion.

3. The intermediate electrical connector according to claim 1, wherein said ground terminal further include a through hole formed in the second connecting portion, and said second ground plate includes a protruding portion for being accommodated in the through hole.

4. The intermediate electrical connector according to claim 1, wherein said second connecting portion has a width greater than that of the second upper contact portion and the second lower contact portion.

5. The intermediate electrical connector according to claim 1, wherein said second connecting portion has a width greater than that of the first connecting portion.

6. The intermediate electrical connector according to claim 1, wherein said second ground plate has a length greater than that of the first ground plate.

7. An electrical connector assembled component, comprising:

the intermediate electrical connector according to claim 1; and a first mating connector as the mating connecting member, wherein said first mating connector includes a mating signal terminal, a mating ground terminal, a mating ground plate, and a housing for retaining the mating signal terminal, the mating ground terminal, and the mating ground plate, said mating signal terminal includes a first mating contact portion and a first mating connecting portion connected to the first mating contact portion, said mating ground terminal includes a second mating contact portion and a second mating connecting portion connected to the second mating contact portion, said mating ground plate is situated on one side of the mating terminal over the first mating connecting portion and the second mating connecting portion, and said mating ground plate is arranged to contact with the second mating connecting portion.

8. The electrical connector assembled component according to claim 7, further comprising a second mating connector; and a joining member for joining the first mating connector and the second mating connector, wherein said joining member is connected to the mating ground plate.

* * * * *